US010702021B2

(12) United States Patent
Amos et al.

(10) Patent No.: US 10,702,021 B2
(45) Date of Patent: Jul. 7, 2020

(54) GROUND-ENGAGING STRUCTURES FOR ARTICLES OF FOOTWEAR

(71) Applicant: NIKE, Inc., Beaverton, OR (US)

(72) Inventors: Michael S. Amos, Beaverton, OR (US); Thomas G. Bell, Portland, OR (US); Lysandre Follet, Portland, OR (US); Thomas Foxen, Portland, OR (US); John Hurd, Lake Oswego, OR (US); Shane S. Kohatsu, Portland, OR (US); Troy C. Lindner, Portland, OR (US); Geng Luo, Portland, OR (US); Adam Thuss, Portland, OR (US); Andrea Vinet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 260 days.

(21) Appl. No.: 15/575,888

(22) PCT Filed: May 20, 2016

(86) PCT No.: PCT/US2016/033557

§ 371 (c)(1),
(2) Date: Nov. 21, 2017

(87) PCT Pub. No.: WO2016/191285

PCT Pub. Date: Dec. 1, 2016

(65) Prior Publication Data

US 2018/0146742 A1 May 31, 2018

Related U.S. Application Data

(60) Provisional application No. 62/165,659, filed on May 22, 2015.

(51) Int. Cl.
*A43C 15/16* (2006.01)
*A43B 5/00* (2006.01)
(Continued)

(52) U.S. Cl.
CPC ..... *A43C 15/165* (2013.01); *A43B 1/0009* (2013.01); *A43B 5/00* (2013.01);
(Continued)

(58) Field of Classification Search
CPC ..... A43C 15/16; A43C 15/162; A43C 15/165; A43C 15/167; A43B 13/141;
(Continued)

(56) References Cited

U.S. PATENT DOCUMENTS

2002/0062578 A1* 5/2002 Lussier ..... A43B 5/02 36/59 R
2005/0193592 A1* 9/2005 Dua ..... A43B 1/04 36/45
(Continued)

FOREIGN PATENT DOCUMENTS

DE 912545 C 5/1954
DE 102013202353 A1 8/2014
(Continued)

OTHER PUBLICATIONS

Aug. 4, 2016—International Search Report—PCT/US2016/033557.

*Primary Examiner* — Megan E Lynch
(74) *Attorney, Agent, or Firm* — Banner & Witcoff, Ltd.

(57) ABSTRACT

Ground-engaging components for articles of footwear include: (a) an outer perimeter boundary rim that at least partially defines an outer perimeter of the ground-engaging component, wherein the outer perimeter boundary rim defines an upper-facing surface and a ground-facing surface
(Continued)

opposite the upper-facing surface, wherein the outer perimeter boundary rim defines an open space at least at a forefoot support area of the ground-engaging component; and (b) a matrix structure extending from the outer perimeter boundary rim (e.g., the ground-facing surface and/or the upper-facing surface) and across the open space at least at the forefoot support area to define an open cellular construction with plural open cells across the open space at least at the forefoot support area, wherein a plurality (e.g., at least a majority) of the open cells have curved perimeters with no distinct corners.

20 Claims, 12 Drawing Sheets

(51) Int. Cl.

| | |
|---|---|
| ***A43B 1/00*** | (2006.01) |
| ***A43B 13/12*** | (2006.01) |
| ***A43B 13/22*** | (2006.01) |
| ***A43B 5/06*** | (2006.01) |
| ***A43B 13/26*** | (2006.01) |

(52) U.S. Cl.
CPC ..... *A43B 5/06* (2013.01); *A43B 13/122* (2013.01); *A43B 13/223* (2013.01); *A43B 13/26* (2013.01)

(58) Field of Classification Search
CPC ..... A43B 13/223; A43B 13/26; A43B 5/001; A43B 5/02; A43B 5/06
See application file for complete search history.

(56) References Cited

U.S. PATENT DOCUMENTS

| | | | | |
|---|---|---|---|---|
| 2009/0100716 | A1* | 4/2009 | Gerber | A43B 5/02 36/114 |
| 2011/0192056 | A1* | 8/2011 | Geser | A43B 13/26 36/114 |
| 2012/0036740 | A1* | 2/2012 | Gerber | A43B 5/02 36/134 |
| 2013/0047465 | A1* | 2/2013 | Auger | A43B 13/223 36/66 |
| 2013/0055596 | A1* | 3/2013 | Wan | A43B 13/141 36/25 R |
| 2013/0055599 | A1* | 3/2013 | Peikert | A43B 7/125 36/30 R |
| 2013/0067773 | A1* | 3/2013 | Auger | A43B 5/02 36/103 |
| 2013/0118036 | A1* | 5/2013 | Gibson | A43B 1/0009 36/103 |
| 2014/0026443 | A1* | 1/2014 | Derrier | A43B 13/14 36/107 |
| 2014/0026444 | A1* | 1/2014 | Howley | A43B 13/14 36/134 |
| 2014/0202042 | A1* | 7/2014 | Berend | A43B 13/141 36/25 R |
| 2014/0215853 | A1* | 8/2014 | Rushbrook | A43B 5/001 36/102 |
| 2014/0215862 | A1* | 8/2014 | Curl | A43C 1/00 36/59 R |
| 2015/0128455 | A1* | 5/2015 | Lubart | A43B 13/22 36/25 R |

FOREIGN PATENT DOCUMENTS

| | | | |
|---|---|---|---|
| EP | 2767181 | A1 | 8/2014 |
| FR | 2029304 | A5 | 10/1970 |
| WO | 2008124164 | A1 | 10/2008 |

* cited by examiner

GROUND-ENGAGING STRUCTURES FOR ARTICLES OF FOOTWEAR

CROSS-REFERENCE TO RELATED APPLICATION

This application is a U.S. National Stage application under 35 U.S.C. § 371 of International Application PCT/US2016/033557, filed May 20, 2016, which claims priority to U.S. Provisional Patent Application No. 62/165,659, titled "Ground-Engaging Structures for Articles of Footwear" and filed May 22, 2015. These applications in their entirety, are incorporated by reference herein.

FIELD OF INVENTION

The present invention relates to the field of footwear. More specifically, aspects of the present invention pertain to articles of athletic footwear and/or ground-engaging structures for articles of footwear, e.g., used in track and field events and/or short to middle distance running events (e.g., for 200 m, 400 m, 800 m, 1500 m, etc.).

TERMINOLOGY/GENERAL INFORMATION

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1 also provides information that may be useful for explaining and understanding the specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight or force applied to it other than potentially the weight/force of the shoe components with which it is engaged). If the forwardmost and/or rearmost locations of a specific footwear component 100 constitute a line segment (rather than a tangent point), then the forwardmost toe location and/or the rearmost heel location constitute the mid-point of the corresponding line segment. If the forwardmost and/or rearmost locations of a specific footwear component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S in an unloaded condition, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

SUMMARY

This Summary is provided to introduce some concepts relating to this invention in a simplified form that are further described below in the Detailed Description. This Summary is not intended to identify key features or essential features of the invention.

While potentially useful for any desired types or styles of shoes, aspects of this invention may be of particular interest for athletic shoes, including track shoes or shoes for short to middle distance runs (e.g., for 200 m, 400 m, 800 m, 1500 m, etc.) and/or track shoes for running races on a curved and/or banked track.

Some aspects of this invention relate to ground-engaging components for articles of footwear that include: (a) an outer perimeter boundary rim (e.g., at least 3 mm wide (0.12 inches) or 4 mm wide (0.16 inches)) that at least partially defines an outer perimeter of the ground-engaging component (e.g., the outer perimeter boundary rim may be present around at least 80% or at least 90% of the outer perimeter of the ground-engaging component), wherein the outer perimeter boundary rim defines an upper-facing surface and a ground-facing surface opposite the upper-facing surface, wherein the outer perimeter boundary rim defines an open space at least at a forefoot support area of the ground-engaging component (and optionally over the arch support and/or heel support areas as well); and (b) a matrix structure (also called a "support structure" herein) extending from the outer perimeter boundary rim (e.g., from the ground-facing surface and/or the upper-facing surface) and at least partially across the open space at least at the forefoot support area to define an open cellular construction with plural open cells across the open space at least at the forefoot support area, wherein a plurality (e.g., at least a majority (and in some examples, at least 55%, at least 60%, at least 70%, at least 80%, at least 90%, or even at least 95%)) of the open cells of the open cellular construction have curved perimeters with no distinct corners.

In at least some example structures in accordance with aspects of this invention, the matrix structure further may define one or more partially open cells located within the open space and/or one or more closed cells (e.g., at the ground-facing surface of the outer perimeter boundary rim). The open space and/or the matrix structure may extend to all areas of the ground-engaging component inside its outer perimeter boundary rim (e.g., from front toe to rear heel, from medial side edge to lateral side edge, etc.). Furthermore, the matrix structure in at least some ground-engaging components in accordance with this invention will define secondary traction elements, e.g., at corners defined by the matrix structure around the open cells, partially open cells, and/or closed cells.

Additionally or alternatively, if desired, the matrix structure may define one or more cleat support areas for engaging or supporting primary traction elements, such as track spikes or other cleat elements (e.g., permanently fixed cleats or track spikes, removable cleats or track spikes, etc.). The cleat support area(s) may be located: (a) within the outer perimeter boundary rim (e.g., on its ground-facing surface), (b) at least partially within the outer perimeter boundary rim (e.g., at least partially within its ground-facing surface), (c) within the open space, (d) extending from the outer perimeter boundary rim into and/or across the open space, and/or (e) between a lateral side of the outer perimeter boundary rim and a medial side of the outer perimeter boundary rim. The matrix structure further may define a plurality of secondary traction elements at various locations, e.g., dispersed around one or more of any present cleat support areas; between open and/or partially open cells of the matrix structure; at the outer perimeter boundary rim; at "corners" of the matrix structure; etc. As some more specific examples, the matrix structure may define at least four secondary traction elements dispersed around at least some individual open cells of the open cellular construction that have the curved perimeters with no distinct corners, and optionally, six secondary traction elements may be disposed around at least some of the individual open cells of the open cellular construction that have the curved perimeters with no distinct corners (e.g., in a generally hexagonal arrangement of secondary traction elements). At least some of the plurality of individual open cells that include secondary traction elements dispersed around them may be located at a medial forefoot support area, a central forefoot support area, a lateral forefoot support area, a first metatarsal head support area, a forward toe support area, and/or a heel area of the ground-engaging component.

While primary traction elements may be provided at any desired locations on ground-engaging components in accordance with this invention, in some example structures the cleat support areas for primary traction elements will be provided at least at two or more of the following: (a) a first cleat support area (and optionally with an associated primary traction element) at or at least partially in a lateral side of the ground-facing surface of the outer perimeter boundary rim; (b) a second cleat support area (and optionally with an associated primary traction element) at or at least partially in a medial side of the ground-facing surface of the outer perimeter boundary rim; (c) a third cleat support area (and optionally with an associated primary traction element) at or at least partially in a medial side of the ground-facing surface of the outer perimeter boundary rim and located forward of the second cleat support area; and/or (d) a fourth cleat support area (and optionally with an associated primary traction element) at or at least partially in the ground-facing surface of the outer perimeter boundary rim and located forward of at least one of the second or third cleat support areas. All of these four cleat support areas (and/or any associated primary traction element) may be located forward of a perpendicular plane oriented at 0.55L of the ground-engaging component and/or sole structure. Although some ground-engaging components according to some aspects of this invention will include only these four cleat support areas (and associated primary traction elements), more or fewer cleat support areas (and primary traction elements associated therewith) may be provided, if desired.

The matrix structure in accordance with at least some examples of this invention may include at least one set of open and/or partially open cells, wherein geographical centers of at least three cells of this first set of "at least partially open cells" are "substantially aligned" or "highly substantially aligned" (the term "at least partially open cells" means one or more of partially open cells and/or open cells, which terms will be explained in more detail below). Optionally, the geographic centers of at least three cells (and in some examples, at least four cells or even at least six cells) of this first set will be "substantially aligned" or "highly substantially aligned," optionally in the forefoot support area, along a line that extends from a rear lateral direction toward a forward medial direction of the ground-engaging component and/or the article of footwear in which it may be contained. Open or partially open cells are considered to be "substantially aligned," as that term is used herein in this context, if the geographical centers of each of the cells in question lie on a straight line and/or within a distance of 10 mm (0.39 inches) from a straight line. "Highly substantially aligned" cells each have their geographic centers lying on a straight line and/or within a distance of 5 mm (0.2 inches) from a straight line. Matrix structures in accordance with at least some examples of this invention may include two or more sets of open and/or partially open cells, wherein geographical centers of at least three cells within the respective sets are substantially aligned or highly substantially aligned with a straight line for that set (and optionally substantially aligned or highly substantially aligned with a straight line that extends from the rear lateral direction toward the forward medial direction of the ground-engaging component and/or sole structure). Some matrix structures in accordance with this invention may include from 2 to 20 sets of substantially aligned cells and/or highly substantially aligned cells, or even from 3-15 sets of substantially aligned cells and/or highly substantially aligned cells. When multiple sets of substantially aligned cells and/or highly substantially aligned cells are present in a matrix structure, the aligned and/or highly aligned sets of cells may be separated from one another along the front-to-back and/or longitudinal direction of the ground-engaging component and/or sole structure.

Additional aspects of this invention relate to sizes and relative sizes of cells within the support/matrix structure. In general, smaller cells sizes will result in more support, more stiffness, and less flexibility than larger cell sizes (e.g., assuming common materials, thicknesses, and/or structures). In at least some examples of this invention, an average open cell size defined by the matrix structure on a medial forefoot side support area (and/or on a medial side of a front-to-rear center line) of the ground-engaging component will be smaller than an average open cell size defined by the matrix structure on a lateral forefoot side support area (and/or on a lateral side of the front-to-rear center line) of the ground-engaging component. As another example, an average open cell size defined by the matrix structure in a first metatarsal head support area ("big toe" side support area) of the ground-engaging component will be smaller than an average open cell size defined by the matrix structure in a fourth and/or fifth metatarsal head support area ("little toe" side support area(s)) of the ground-engaging component.

As some additional potential features, in the arch support area and/or the forefoot support area, the matrix structure may define a first open cell and an adjacent second open cell, wherein the first open cell has a cross sectional area (e.g., area of the opening) of less than 50% (and in some examples, less than 40%, less than 30%, or even less than 25%) of a cross sectional area (e.g., area of the opening) of the second open cell, and wherein a geographic center of the first open cell is located closer to the medial side edge of the ground-engaging component than is a geographic center of the second open cell. A cell is "adjacent" to another cell if a straight line can be drawn to connect openings of the two cells without that straight line crossing through the open space of another cell and/or passing between two other adjacent cells and/or if the two cells share a wall. "Adjacent cells" also may be located close to one another (e.g., so that a straight line distance between the openings of the cells is less than 1 inch (2.54 cm) long (and in some examples, less than 0.5 inches (1.27 cm) long)). In these arrangements, the second open cell (the cell further from the medial side) may be elongated in a medial side-to-lateral side direction and/or the first open cell (the cell closer to the medial side) may be elongated in a front-to-rear direction.

In the forefoot support area, such a matrix structure may further define a first open cell, an adjacent second open cell, and an adjacent third open cell, wherein the first open cell has a cross sectional area (e.g., area of the opening) of less than 50% of a cross sectional area (e.g., area of the opening) of the second open cell and/or of less than 50% of a cross sectional area (e.g., area of the opening) of the third open cell. In such an arrangement, a geographic center of the first open cell may be located closer to the medial side edge than is a geographic center of the second open cell and/or closer to the medial side edge than is a geographic center of the third open cell. If desired, the first open cell may be elongated in a front-to-rear direction.

The forefoot area of some example matrix structures in accordance with this invention further may define a fourth open cell that is adjacent to the third open cell and a fifth open cell, wherein the fourth open cell has a cross sectional area (e.g., area of the opening) of less than 50% of the cross sectional area (e.g., area of the opening) of the third open cell and/or of less than 50% of a cross sectional area (e.g., area of the opening) of the fifth open cell. In this arrangement, a geographic center of the fourth open cell may be located closer to the medial side edge than is the geographic center of the third open cell and/or closer to the medial side edge than is a geographic center of the fifth open cell.

As other options, the forefoot area of such a matrix structure further may include a fourth open cell that is adjacent to a fifth open cell and a sixth open cell, wherein the fourth open cell has a cross sectional area (e.g., area of the opening) of less than 50% of the cross sectional area (e.g., area of the opening) of the fifth open cell and/or of less than 50% of a cross sectional area (e.g., area of the opening) of the sixth open cell. In this arrangement, a geographic center of the fourth open cell may be located closer to the medial side edge than is the geographic center of the fifth open cell and/or closer to the medial side edge than is a geographic center of the sixth open cell. If desired, in this arrangement, the first open cell (described above) may be separated from the fourth open cell by a seventh open cell, and this seventh open cell may be located adjacent to the third open cell and the fifth open cell. Also, if desired, this seventh open cell may have a cross sectional area (e.g., area of the opening) of less than 50% of the cross sectional area (e.g., area of the opening) of the third open cell and/or of less than 50% of a cross sectional area (e.g., area of the opening) of the fifth open cell, and wherein a geographic center of the seventh open cell is located closer to the medial side edge than is the geographic center of the third open cell and/or closer to the medial side edge than is the geographic center of the fifth open cell.

Additional aspects of this invention relate to articles of footwear that include an upper and a sole structure engaged with the upper. The sole structure will include a ground-engaging component having any one or more of the features described above and/or any combinations of features described above. The upper may be made from any desired upper materials and/or upper constructions, including upper materials and/or upper constructions as are conventionally known and used in the footwear art (e.g., especially upper materials and/or constructions used in track shoes or shoes for short and/or middle distance runs (e.g., for 200 m, 400 m, 800 m, 1500 m, etc.)). As some more specific examples, at least a portion (or even a majority, all, or substantially all) of the upper may include a woven textile component and/or a knitted textile component (and/or other lightweight constructions).

Articles of footwear in accordance with at least some examples of this invention will not include an external midsole component (e.g., located outside of the upper).

Rather, in at least some examples of this invention, the sole structure will consist essentially of the ground-engaging component, and the article of footwear will consist essentially of an upper (and its one or more component parts, including any laces or other securing system components and/or an interior insole or sock liner component) with the ground-engaging component engaged with it. Some articles of footwear according to aspects of this invention will include the upper-facing surface of the ground-engaging support component directly engaged with the upper (e.g., with a bottom surface of the upper and/or a strobel component). Optionally, the bottom surface of the upper (e.g., a strobel or other upper bottom component) may include a component with desired colors or other graphics to be displayed through the open cells of the matrix structure.

If desired, in accordance with at least some examples of this invention, at least some portion(s) of a bottom surface of the upper (e.g., the strobel) may be exposed at an exterior of the shoe structure. As some more specific examples, the bottom surface of the upper may be exposed: (a) in the open space of the ground-engaging component (e.g., at least in the forefoot support area through open cells and/or partially open cells in any present matrix structure, etc.); (b) in the arch support area of the sole structure (e.g., through open cells and/or partially open cells in any present matrix structure, etc.); and/or (c) in the heel support area of the sole structure (e.g., through open cells and/or partially open cells in any present matrix structure, etc.).

Additional aspects of this invention relate to methods of making ground-engaging support components, sole structures, and/or articles of footwear of the various types and structures described above.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

Figure 2A:
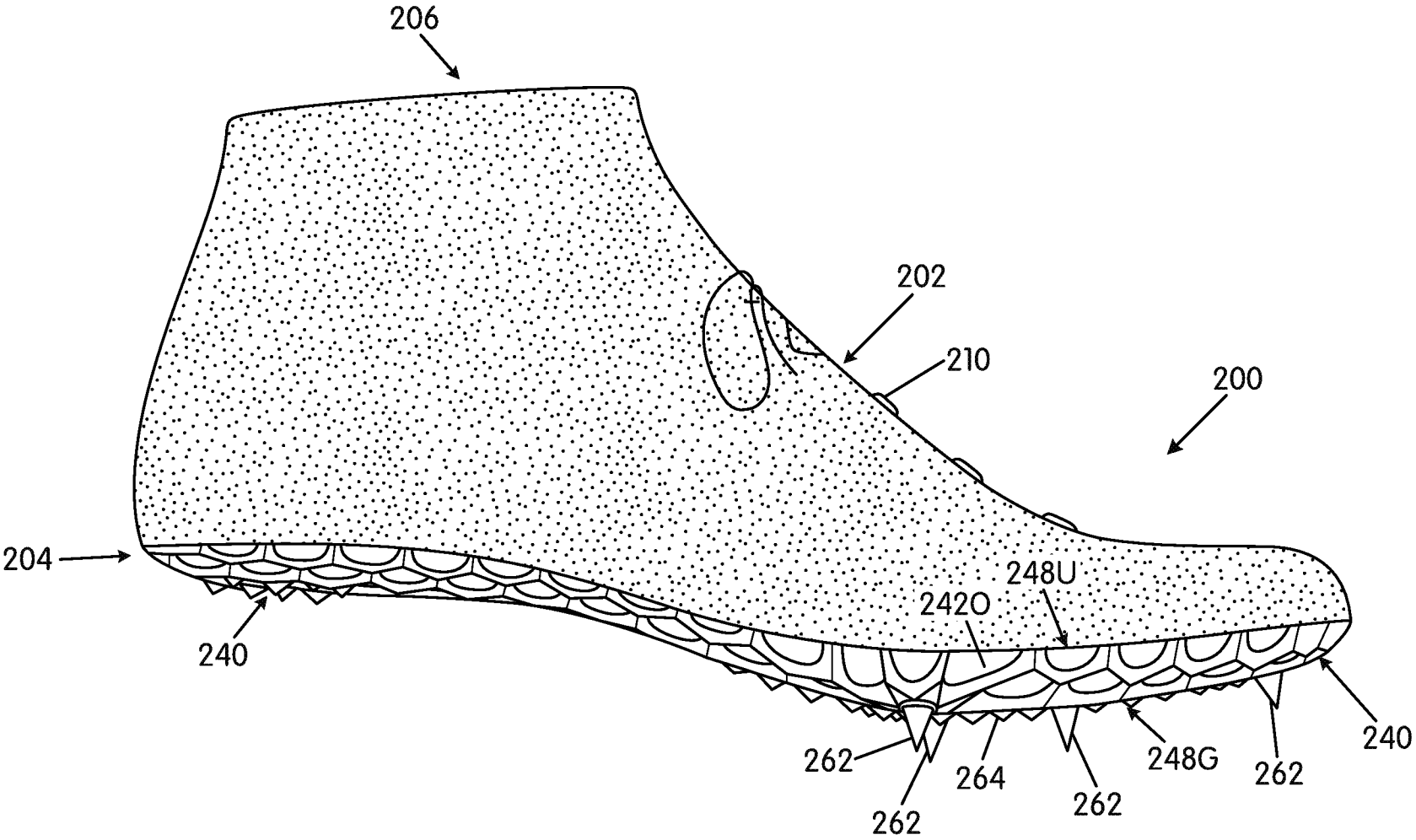
FIGS. 2A-2D provide a lateral side view, a bottom view, an enlarged bottom view around a cleat mount area, and an enlarged perspective view around a cleat mount area, respectively, of an article of footwear in accordance with at least some aspects of this invention.
Figure 2B:
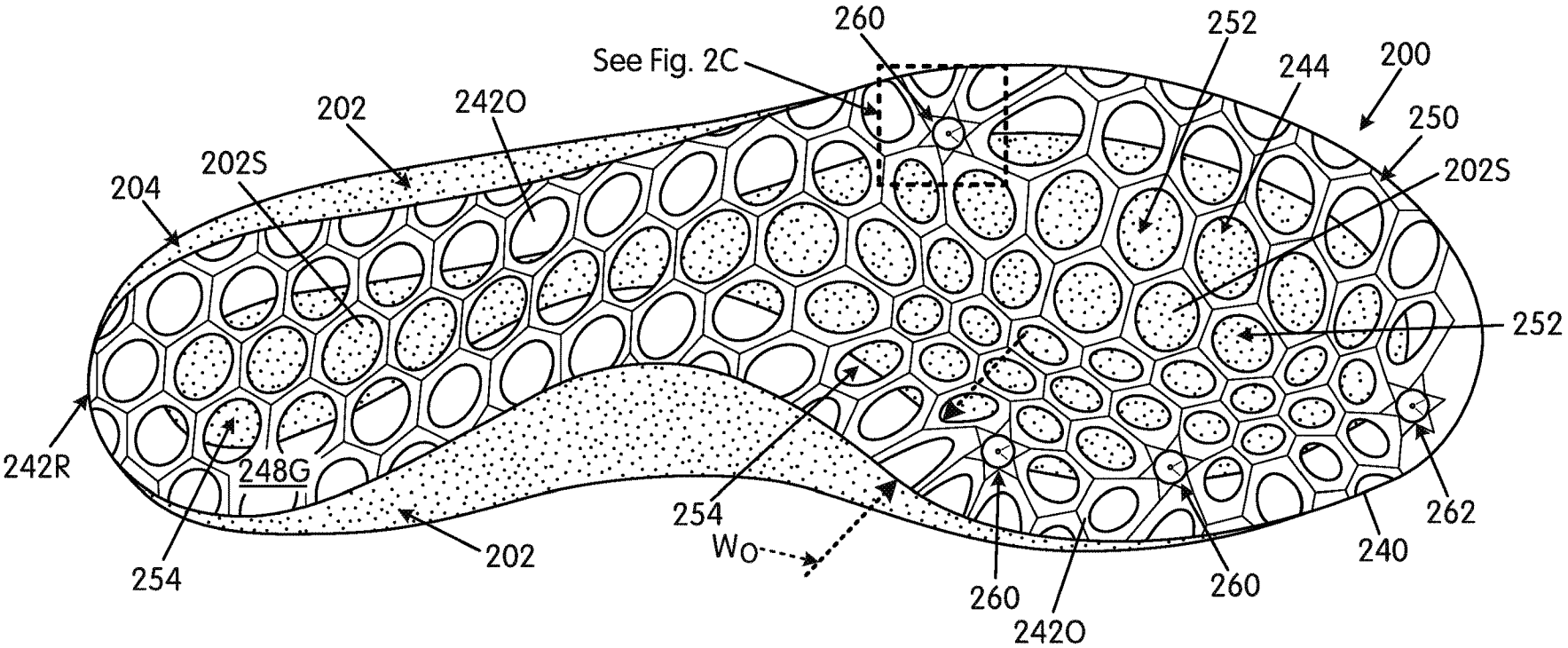
Figure 2D:
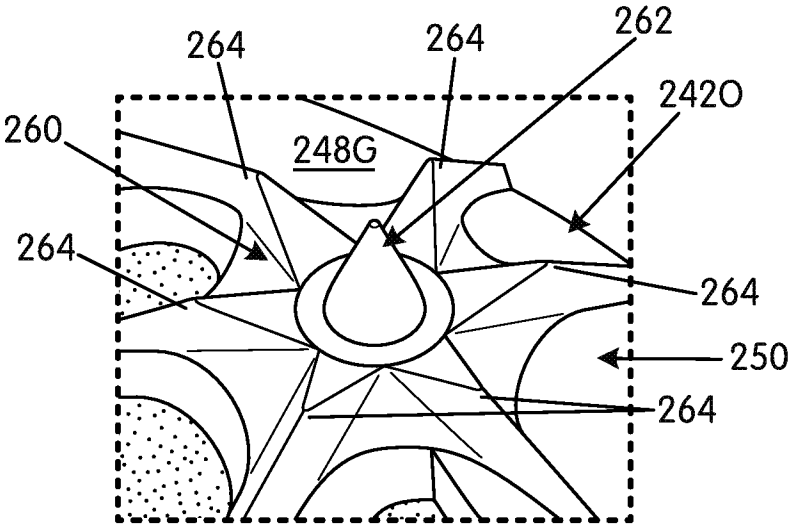
Figure 2C:
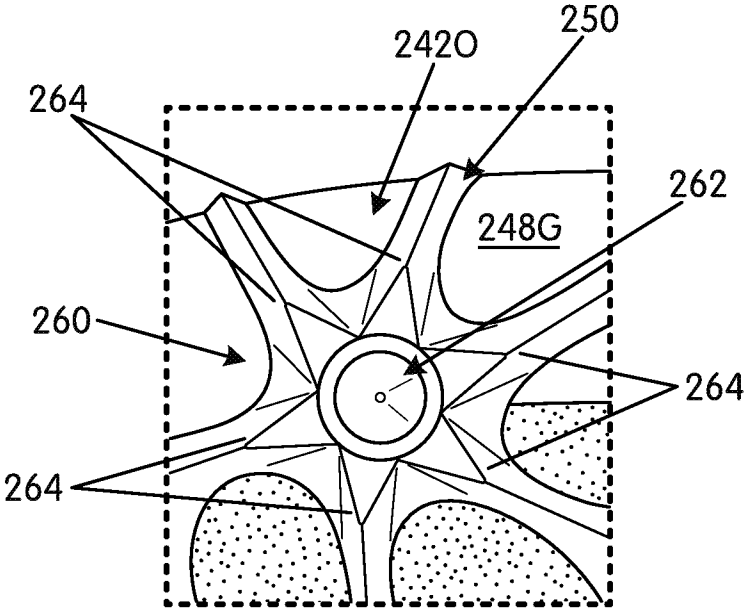

FIGS. 2A and 2B provide lateral side and bottom views, respectively, of an article of footwear 200 in accordance with at least some aspects of this invention. This example article of footwear 200 is a track shoe, and more specifically, a track shoe targeted for short or middle distance runs, such as 200 m, 400 m, 800 m, 1500 m, etc. (e.g., races typically run on a curved and/or banked track). Aspects of this invention, however, also may be used in shoes for other distance runs and/or other types of uses or athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further may include a tongue member located across the foot instep area and positioned so as to moderate the feel of the closure system 210 (which in this illustrated example constitutes a lace type closure system).

As mentioned above, the upper 202 may be made from any desired materials and/or in any desired constructions and/or manners without departing from this invention. As some more specific examples, at least a portion of the upper 202 (and optionally a majority, all, or substantially all of the upper 202) may be formed as a woven textile component and/or a knitted textile component. The textile components for upper 202 may have structures and/or constructions like those provided in FLYKNIT® brand footwear and/or via FLYWEAVE™ technology available in products from NIKE, Inc. of Beaverton, Oreg.

Additionally or alternatively, if desired, the upper 202 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this invention may include foot securing and engaging structures of the types used in FLYWIRE® Brand footwear available from NIKE, Inc. of Beaverton, Oreg. Additionally or alternatively, if desired, uppers and articles of footwear in accordance with this invention may include fused layers of upper materials, e.g., uppers of the types included in NIKE's "FUSE" line of footwear products. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

The sole structure 204 of this example article of footwear 200 now will be described in more detail. As shown in FIGS. 2A and 2B, the sole structure 204 of this example includes one main component, namely a ground-engaging component 240, optionally engaged with the bottom surface 202S (e.g., a strobel member) and/or side surface of the upper 202 via adhesives or cements, mechanical fasteners, sewing or stitching, etc. The ground-engaging component 240 of this example has its rearmost extent 242R located at a rear heel support area.

Notably, in this illustrated example, no external midsole or internal midsole component (e.g., a foam material, a fluid-filled bladder, etc.) is provided. In this manner, the shoe/sole components will absorb little energy from the user when racing, and the vast majority of the force applied to the shoe by the user will be transferred to the contact surface (e.g., the track or ground). If desired, an interior insole component (or sock liner) may be provided to at least somewhat enhance the comfort of the shoe. Alternatively, if desired, a midsole component could be provided and located between (a) a bottom surface of the upper 202 (e.g., a strobel member) and (b) the ground-engaging component 240. Preferably, the midsole component, if any, will be thin, lightweight component, such as one or more of a foam material, a fluid-filled bladder, etc.

In this illustrated example, a bottom surface 202S of the upper 202 is exposed at an exterior of the sole structure 204 substantially throughout the bottom of the sole structure 204 (and exposed over more than 40%, more than 50%, and even more than 75% of the bottom surface area of the sole structure 204). As shown in FIG. 2B, the bottom surface 202S of the upper 202 is exposed at the forefoot support area, the arch support area, and/or the heel support area (through open cells 252 or any partially open cells 254 of the ground-engaging component 240 (also called the "open space" 244 herein) described in more detail below).

Example ground-engaging components 240 for sole structures 204/articles of footwear 200 in accordance with examples of this invention now will be described in more detail with reference to FIGS. 2A-2D and FIGS. 3A-3E. As shown, these example ground-engaging components 240 include an outer perimeter boundary rim 242O, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" $W_O$ is defined as the direct, shortest distance from one (e.g., exterior) edge of the outer perimeter boundary rim 242O to its opposite (e.g., interior) edge by the open space 244, as shown in FIG. 2B. While FIG. 2B shows this outer perimeter boundary rim 242O extending completely and continuously around and defining 100% of an outer perimeter of the ground-engaging component 240, other options are possible. For example, if desired, there may be one or more breaks in the outer perimeter boundary rim 242O at the outer perimeter of the ground-engaging component 240 such that the outer perimeter boundary rim 242O is present around only at least 75%, at least 80%, at least 90%, or even at least 95% of the outer perimeter of the ground-engaging component 240. The outer perimeter boundary rim 242O may have a constant or changing width $W_O$ over the course of its perimeter. The outer perimeter boundary rim 242O also may extend to define the outer edge of the sole structure 204.

FIG. 2B further shows that the outer perimeter boundary rim 242O of the ground-engaging component 240 defines an open space 244 at least at a forefoot support area of the ground-engaging component 240, and in this illustrated example, the open space 244 extends into the arch support area and the heel support area of the ground-engaging component 240. The rearmost extent 242R of the outer perimeter boundary rim 242O of these examples is located within the heel support area, and optionally at a rear heel support area of the ground-engaging component 240. The ground-engaging component 240 may fit and be fixed to a bottom surface 202S and/or side surface of the upper 202, e.g., by cements or adhesives, etc.

The ground-engaging components 240 of these examples are shaped so as to extend completely across the forefoot support area of the sole structure 204 from the lateral side to the medial side. In this manner, the outer perimeter boundary rim 242O forms the medial and lateral side edges of the bottom of the sole structure 204 at least at the forefoot medial and forefoot lateral sides and around the front toe area. The ground-engaging component 240 also may extend completely across the sole structure 204 from the lateral side edge to the medial side edge at other areas of the sole structure 204, including throughout the longitudinal length of the sole structure 204. In this manner, the outer perimeter boundary rim 242O may form the medial and lateral side edges of the bottom of the sole structure 204 throughout the sole structure 204, if desired.

The outer perimeter boundary rim 242O of this illustrated example ground-engaging component 240 defines an upper-facing surface 248U (e.g., see FIGS. 2A, 3E and 5F) and a ground-facing surface 248G (e.g., as shown in FIGS. 2A-2C and 3D) opposite the upper-facing surface 248U. The upper-facing surface 248U provides a surface (e.g., a smooth and/or contoured surface) for supporting the wearer's foot and/or engaging the upper 202 (and/or optionally engaging any present midsole component 220). The outer perimeter boundary rim 242O may provide a relatively large surface area for securely supporting a plantar surface of a wearer's foot. Further, the outer perimeter boundary rim 242O may provide a relatively large surface area for securely engaging another footwear component (such as the bottom surface 202S of the upper 202), e.g., a surface for bonding via adhesives or cements, for supporting stitches or sewn seams, for supporting mechanical fasteners, etc.

FIGS. 2B, 2C, 3D, and 3E further illustrate that the ground-engaging component 240 of this example sole structure 204 includes a support structure 250 that extends from the outer perimeter boundary rim 242O into and at least partially across (and optionally completely across) the open space 244. The top surface of this example support structure 250 at locations within the open space 244 lies flush with and/or smoothly transitions into the outer perimeter boundary rim 242O to provide a portion of the upper-facing surface 248U (and may be used for the purposes of the upper-facing surface 248U as described above).

The support structure 250 of these examples extends from the ground-facing surface 248G of the outer perimeter boundary rim 242O to define at least a portion of the ground-facing surface 248G of the ground-engaging component 240. In the illustrated examples of FIGS. 2A-2C and 3D-3E, the support structure 250 includes a matrix structure (also labeled 250 herein) extending from the ground-facing surface 248G of the outer perimeter boundary rim 242O and into, partially across, or fully across the open space 244 to define a cellular construction. The illustrated matrix structure 250 defines at least one of: (a) one or more open cells located within the open space 244, (b) one or more partially open cells located within the open space 244, and/or (c) one or more closed cells, e.g., located beneath the outer perimeter boundary rim 242O. An "open cell" constitutes a cell in which the perimeter of the cell opening is defined completely by the matrix structure 250 (note, for example, cells 252 in FIG. 2B). A "partially open cell" constitutes a cell in which one or more portions of the perimeter of the cell opening are defined by the matrix structure 250 within the open space 244 and one or more other portions of the perimeter of the cell opening are defined by another structure, such as the outer perimeter boundary rim 242O (note, for example, cells 254 in FIG. 2B). A "closed cell" may have the outer matrix structure 250 but no opening (e.g., it may be formed such that the portion of the matrix 250 that would define the cell opening is located under the outer perimeter boundary rim 242O). As shown in FIG. 2B, in the illustrated example matrix structure 250, at least 50% of the open cells 252 and/or partially open cells 254 of the open cellular construction (and optionally, at least 60%, at least 70%, at least 80%, at least 90%, or even at least 95%) have openings with curved perimeters and no distinct corners (e.g., round, elliptical, and/or oval shaped, e.g., as viewed at least from the upper-facing surface 248U). The open space 244 and/or matrix structure 250 may extend to all areas of the ground-engaging component 240 within the outer perimeter boundary rim 242O.

As further shown in FIGS. 2B-2D and 3D, the matrix structure 250 further defines one or more primary traction element or cleat support areas 260. Four separate cleat support areas 260 are shown in the examples of FIGS. 2A-2D, with: (a) three primary cleat support areas 260 on the medial side of the ground-engaging component 240 (one at or near a medial forefoot support area or a medial midfoot support area of the ground-engaging component 240, one forward of that one in the medial forefoot support area, and one forward of that one at the medial toe support area) and (b) one primary cleat support area 260 on the lateral side of the ground-engaging component 240 (at or near a lateral forefoot support area or a lateral midfoot support area of the ground-engaging component 240). Primary traction elements, such as track spikes 262 or other cleats, may be engaged or integrally formed with the ground-engaging component 240 at the cleat support areas 260 (e.g., with one cleat or track spike 262 provided per cleat support area 260). The cleats or track spikes 262 (also called "primary traction elements" herein) may be permanently fixed at cleat mount areas in their associated cleat support areas 260, such as by in-molding the cleats or track spikes 262 into the cleat support areas 260 when the matrix structure 250 is formed (e.g., by molding). In such structures, the cleat or track spike 262 may include a disk or outer perimeter member that is embedded in the material of the cleat support area 260 during the molding process. As another alternative, the cleats or track spikes 262 may be removably mounted to the ground-engaging component 240 at cleat mount areas, e.g., by a threaded type connector, a turnbuckle type connector, or other removable cleat/spike structures as are known and used in the footwear arts. Hardware or other structures for mounting the removable cleats may be integrally formed in the cleat support area 260 or otherwise engaged in the cleat support area 260 (e.g., by in-molding, adhesives, or mechanical connectors).

The cleat support areas 260 can take on various structures without departing from this invention. In the illustrated example, the cleat support areas 260 are defined by and as part of the matrix structure 250 as a thicker portion of matrix material located within or partially within the outer perimeter boundary rim 242O and/or located within the open space 244. As various options, if desired, one or more of the cleat support areas 260 may be defined in one or more of the following areas: (a) solely in the outer perimeter boundary rim 242O, (b) partially in the outer perimeter boundary rim 242O and partially in the open space 244, and/or (c) completely within the open space 244 (and optionally located at or adjacent the outer perimeter boundary rim 242O). When multiple cleat support areas 260 are present in a single ground-engaging component 240, all of the cleat support areas 260 need not have the same size, construction, and/or orientation with respect to the outer perimeter boundary rim 242O and/or open space 244 (although they all may have the same size, construction, and/or orientation, if desired).

While other constructions are possible, in this illustrated example (e.g., see FIGS. 2B-2D), the cleat support areas 260 are formed as generally hexagonal shaped areas of thicker material into which or at which at least a portion of the cleat/spike 262 and/or mounting hardware will be fixed or otherwise engaged. The cleat support areas 260 are integrally formed as part of the matrix structure 250 in this illustrated example. The illustrated example further shows that the matrix structure 250 defines a plurality of secondary traction elements 264 dispersed around the cleat support areas 260. While other options and numbers of secondary traction elements 264 are possible, in this illustrated example, a secondary traction element 264 is provided at each of the six corners of the generally hexagonal structure making up the cleat support area 260 (such that each cleat support area 260 has six secondary traction elements 264 dispersed around it). The secondary traction elements 264 of this example are raised, sharp points or pyramid type structures made of the matrix 250 material and raised above a base surface 266 of the generally hexagonal cleat support area 260. The free ends of the primary traction elements 262 extend beyond the free ends of the secondary traction elements 264 (in the cleat extension direction and/or when the shoe 200 is positioned on a flat surface) and are designed to engage the ground first. Note FIGS. 2A and 2D. If the primary traction elements 262 sink a sufficient depth into the contact surface (e.g., a track, the ground, etc.), the secondary traction elements 264 then may engage the contact surface and provide additional traction to the wearer. In an individual cleat mount area 260 around a single primary traction element 262, the points or peaks of the immediately surrounding secondary traction elements 264 that surround that primary traction element 262 may be located within 1.5 inches (3.8 cm) (and in some examples, within 1 inch (2.5 cm) or even within 0.75 inch (1.9 cm)) of the peak or point of the surrounded primary traction element 262 in that mount area 260.

In at least some examples of this invention, the outer perimeter boundary rim 242O and the support structure 250 extending into/across the open space 244 may constitute an unitary, one-piece construction. The one-piece construction can be formed from a polymeric material, such as a PEBAX® brand polymer material or a thermoplastic polyurethane material. As another example, if desired, the ground-engaging component 240 may be made as multiple parts (e.g., split at the forward-most toe area, split along the front-to-back direction, and/or split or separated at other areas), wherein each part includes one or more of: at least a portion of the outer perimeter boundary rim 242O and at least a portion of the support structure 250. As another option, if desired, rather than an unitary, one-piece construction, one or more of the outer perimeter boundary rim 242O and the support structure 250 individually may be made of two or more parts. The material of the matrix structure 250 and/or ground-engaging component 240 in general may be relatively stiff, hard, and/or resilient so that when the ground-engaging component 240 flexes in use (e.g., when sprinting or running fast), the material tends to return (e.g., spring) the component 240 back to or toward its original shape and structure when the force is removed or sufficiently relaxed (e.g., as occurs during a step cycle when the foot is lifting off the ground).

Optionally, the outer perimeter boundary rim 242O and the support structure 250, whether made from one part or more, will have a combined mass of less than 95 grams (exclusive of any separate primary traction elements, like spikes 262, and/or primary traction element mounting hardware), and in some examples, a combined mass of less than 75 grams, less than 65 grams, less than 55 grams, or even less than 50 grams. The entire ground-engaging component 240 also may have any of these same weighting characteristics.

Figure 3A:
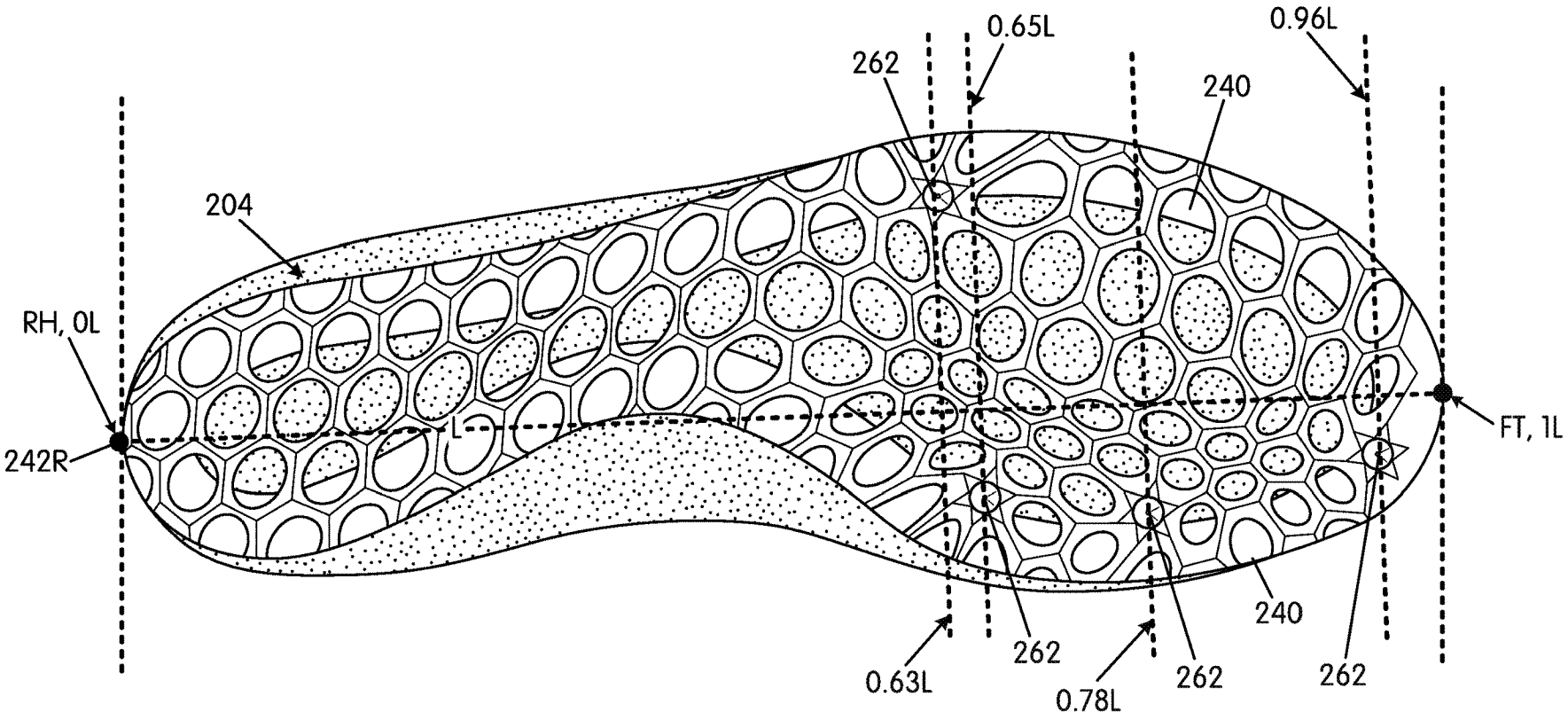
FIGS. 3A-3E and 4 are various views of example sole structures and ground-engaging components in accordance with this invention that illustrate additional example features and aspects of the invention.

FIGS. 3A through 5H are provided to illustrate additional features that may be present in ground-engaging components 240 and/or articles of footwear 200 in accordance with at least some aspects of this invention. FIG. 3A is a view similar to that of FIG. 2B with the rear heel RH and forward toe FT locations of the sole structure 204 identified and the longitudinal length L and direction identified. Planes perpendicular to the longitudinal direction (and going into and out of the page) are shown, and the locations of various footwear 200 and/or ground-engaging component 240 features are described with respect to these planes. For example, FIG. 3A illustrates that the rear-most extent 242R of the ground-engaging component 240 is located at 0L. In some examples of this invention, however, this rear-most extent 242R of the ground-engaging component 240 may be located within a range of 0L and 0.12L, and in some examples, within a range of 0L to 0.1L or even 0L to 0.075L based on the overall sole structure's and/or the article of footwear's longitudinal length L.

Potential primary traction element attachment locations for the four illustrated primary traction elements 262 are described in the following table (with the "locations" being measured from a center location (or point) of the ground-contacting portion of the cleat/spike 262):

| | General Range | More Specific Range | Illustrated Location |
|---|---|---|---|
| Rear Medial Cleat | 0.5 L to 0.75 L | 0.55 L to 0.7 L | 0.65 L |
| Middle Medial Cleat | 0.65 L to 0.88 L | 0.7 L to 0.82 L | 0.78 L |
| Forward Medial Cleat | 0.84 L to 0.99 L | 0.88 L to 0.98 L | 0.96 L |
| Lateral Cleat | 0.5 L to 0.8 L | 0.56 L to 0.72 L | 0.63 L |

Notably, in this illustrated example, the only lateral side primary cleat element 262 (or at least the only lateral side forefoot primary cleat element 262) is located further rearward than all of the medial side primary cleat elements (or at least rearward of all medial side forefoot primary cleat elements 262). If desired, however, one or more additional primary traction elements 262 can be provided at other locations of the ground-engaging component 240 structure, including rearward of either or both of the identified rear cleats, between the identified medial cleats, forward of either or both of the forward-most cleats, and/or between the lateral and medial cleats (e.g., in the matrix structure 250 within the open area 244, at a central forward toe location, etc.).

FIG. 3A further illustrates that the forward-most extent of the outer perimeter boundary rim 242O is located at 1.0L (at the forward-most toe location FT). This forward-most extent of the outer perimeter boundary rim 242O, however, may be located at other places, if desired, such as within a range of 0.90L and 1.0L, and in some examples, within a range of 0.92L to 1.0L.

Figure 3B:
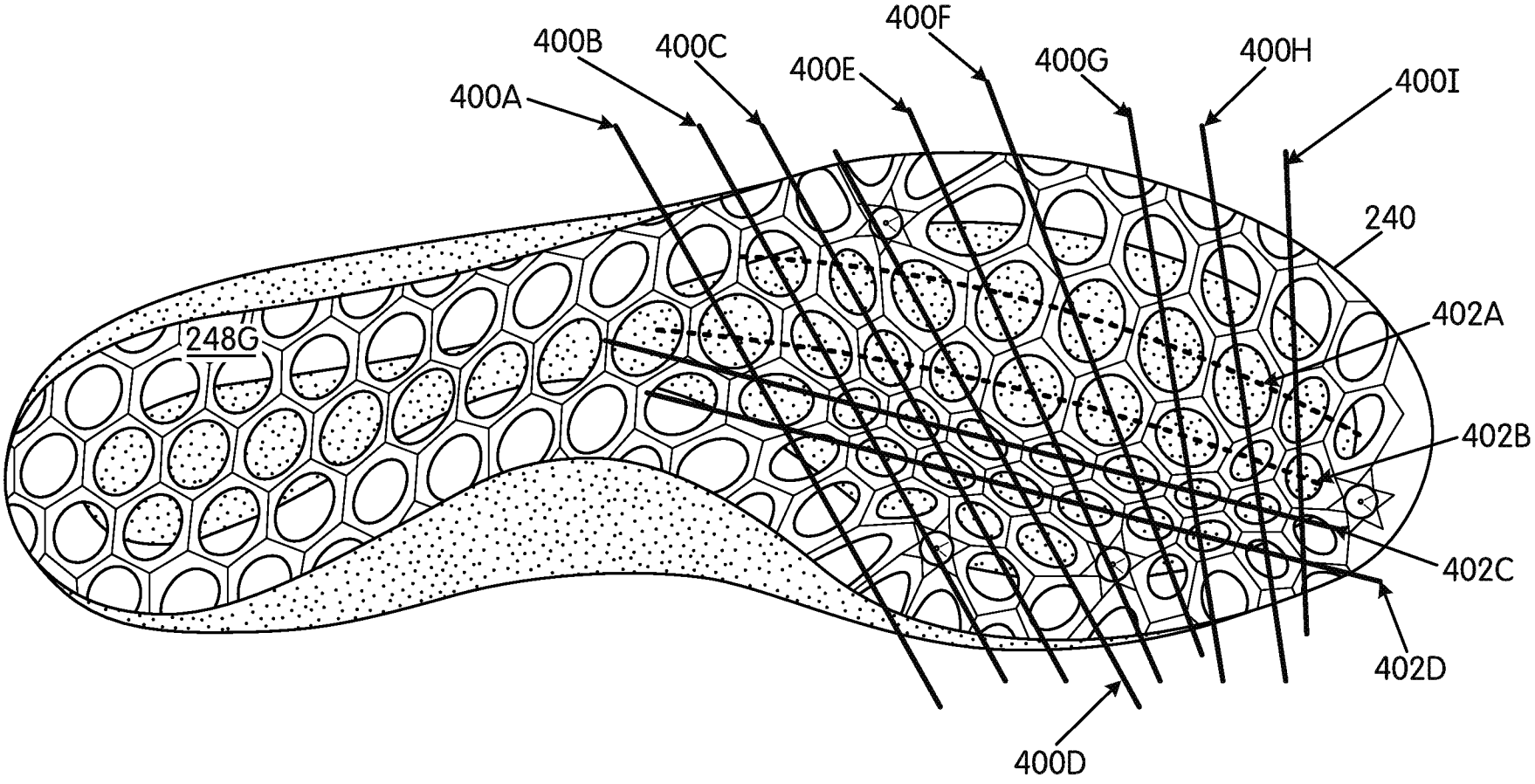

FIG. 3B further illustrates that in this example ground-engaging component structure 240, some cells of the matrix structures 250 are generally formed in lines or along curves that extend across the ground-engaging component 240 and the sole structure 204. The term "cells" used in this context is used generically to refer to any one or more of open cells 252, partially open cells 254, and/or closed cells (e.g., cells completely formed by the matrix structure 250 and closed off within the outer perimeter boundary rim 242O) in any numbers or combinations. In some example structures 240 in accordance with this aspect of the invention, from 3 to 16 "lines" or "curves" of adjacent cells may be formed in the ground-engaging element structure 240 (and in some examples, from 4-12 lines or curves of adjacent cells or even from 6-10 lines or curves of this type). Each "line" or "curve" of adjacent cells extending in the generally medial-to-lateral side direction may contain from 2 to 12 cells, and in some examples, from 3 to 10 cells or from 3-8 cells.

More specifically, and referring to FIG. 3B (which is a view similar to FIG. 2B), the ground-facing surface 248G of the ground-engaging component 240 is shown with additional lines to highlight certain cell features that may be present in at least some example structures according to the invention. For example, this illustrated matrix structure 250 defines several sets of at least partially open cells (meaning open cells 252 and/or partially open cells 254), wherein geographical centers of at least three cells of these sets of at least partially open cells are substantially aligned or highly substantially aligned. Examples of these "sets" of "aligned" cells are shown in FIG. 3B at alignment lines 400A-400I. Notably, while not a requirement for any or all "sets" of three or more aligned cells, the "alignment lines" 400A-400F shown in this illustrated example extend from a rear lateral direction toward a forward medial direction of the ground-engaging component 240 and/or the sole structure 204 (and not necessarily in the direct transverse direction). If desired, any one or more sets of cells may be aligned along a line that extends from the rear lateral direction toward the forward medial direction of the ground-engaging component 240 and/or sole structure 204. These sets of "substantially aligned" or "highly substantially aligned" cells can help provide more natural flexion and motion for the foot, e.g., as the person's weight rolls forward in a direction from the heel to the toe and/or from the midfoot to the toe during a step cycle. For example, the substantially aligned or highly substantially aligned open spaces 244 along lines 400A-400F (as well as lines 400G-400I) provide and help define lines of flex that extend at least partially across the sole structure 204 and/or the ground-engaging component 240 from the lateral side to the medial side direction and help the ground-engaging component 240 bend with the foot as the wearer rolls the foot forward for the toe-off phase of a step cycle.

FIG. 3B further shows sets of adjacent cells located along one or more lines or curves 402A-402D that extend in the generally forward-to-rear direction of the ground-engaging component 240 and/or the sole structure 204. One or more of the lines or curves 402A-402D may be oriented so that their concave surface (if any) faces the medial side of the ground-engaging component 240 and/or sole structure 204 and so that their convex surface (if any) faces the lateral side of the ground-engaging component 240 and/or sole structure 204. The curve(s) (e.g., 402A, 402B) may be generally gently and smoothly curved or relatively linear. While four generally front-to-back sets of adjacent at least partially open cells are shown as lines or curves 402A-402D in FIG. 3B, more or fewer sets could be provided, if desired. As a more specific example, from one to eight linear or curved sets of adjacent at least partially open cells 402A-402D could be provided across the ground-engaging component 240 and/or sole structure 204, and each of these sets of cells 402A-402D may include from 3-12 cells, and in some examples, from 3-10 cells, or from 4-10 cells in the forefoot area. These sets of adjacent at least partially open cells 402A-402D also can help provide more natural flexion and motion for the foot as the person's weight rolls forward from the heel and/or midfoot to the toe and from the lateral side to the medial side during a step cycle. For example, adjacent open spaces 244 along lines or curves 402A-402D provide and help define lines or curves of flex that extend across the foot from the rear-to-front direction and help the ground-engaging component 240 bend along a front-to-back line or curve with the foot as the wearer rolls the foot from the lateral side to the medial side for the toe-off phase of a step cycle.

As shown by FIGS. 2B and 3A-3E, in these illustrated example ground-engaging components 240, an average open cell 252 size defined by the matrix structure 250 on a medial forefoot side support area of the ground-engaging component 240 is smaller than an average open cell 252 size defined by the matrix structure 250 on a lateral forefoot side support area of the ground-engaging component 240. Compare, for example: (a) the areas of the open cells (e.g., cell opening area) along line/curve 402C and those toward the medial side with (b) the areas of the open cells (e.g., cell opening area) along curve 402B and those toward the lateral side. Also, as further shown in these figures, an average open cell 252 size defined by the matrix structure 250 in a first metatarsal head support area ("big toe" side) of the ground-engaging component 240 is smaller than an average open cell 252 size defined by the matrix structure 250 in a fourth and/or fifth metatarsal head support area ("little toe" side) of the ground-engaging component 240. The smaller open cells 252 at the first metatarsal head support area provide somewhat greater stiffness and support, e.g., to receive force/weight during the toe-off or push-off phase of a step cycle.

Figure 1:
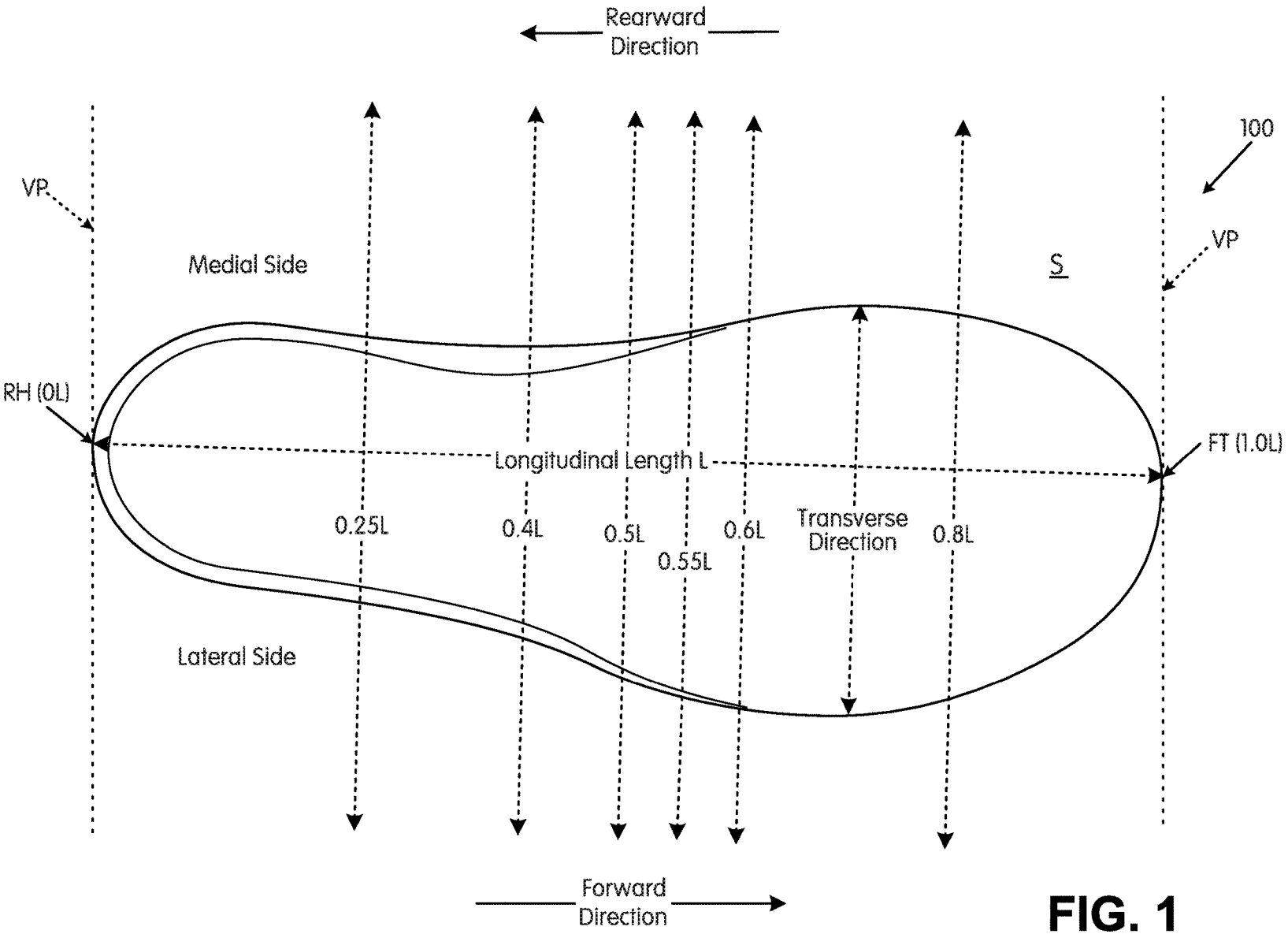
FIG. 1 is provided to help illustrate and explain background and definitional information useful for understanding certain terminology and aspects of this invention.

Also, in this same vein, if desired, the matrix structure 250 may define open cell 252 sizes such that an average open cell size (e.g., cell opening area) defined by the matrix structure 250 on a medial side of a longitudinal center line of the ground-engaging component 240 and/or sole structure 204, at least at the forefoot support area, is smaller than an average open cell size (e.g., cell opening area) defined by the matrix structure 250 on a lateral side of the longitudinal center line, again, at least at the forefoot support area. The "longitudinal center line" of a ground-engaging component 240 and/or a sole structure 204 can be found by locating the center points of line segments extending in the transverse direction (see FIG. 1) from the lateral side edge to the medial side edge of the ground-engaging component 240 and/or the sole structure 204 all along the longitudinal length of the component 240/sole structure 204.

Figure 3C:
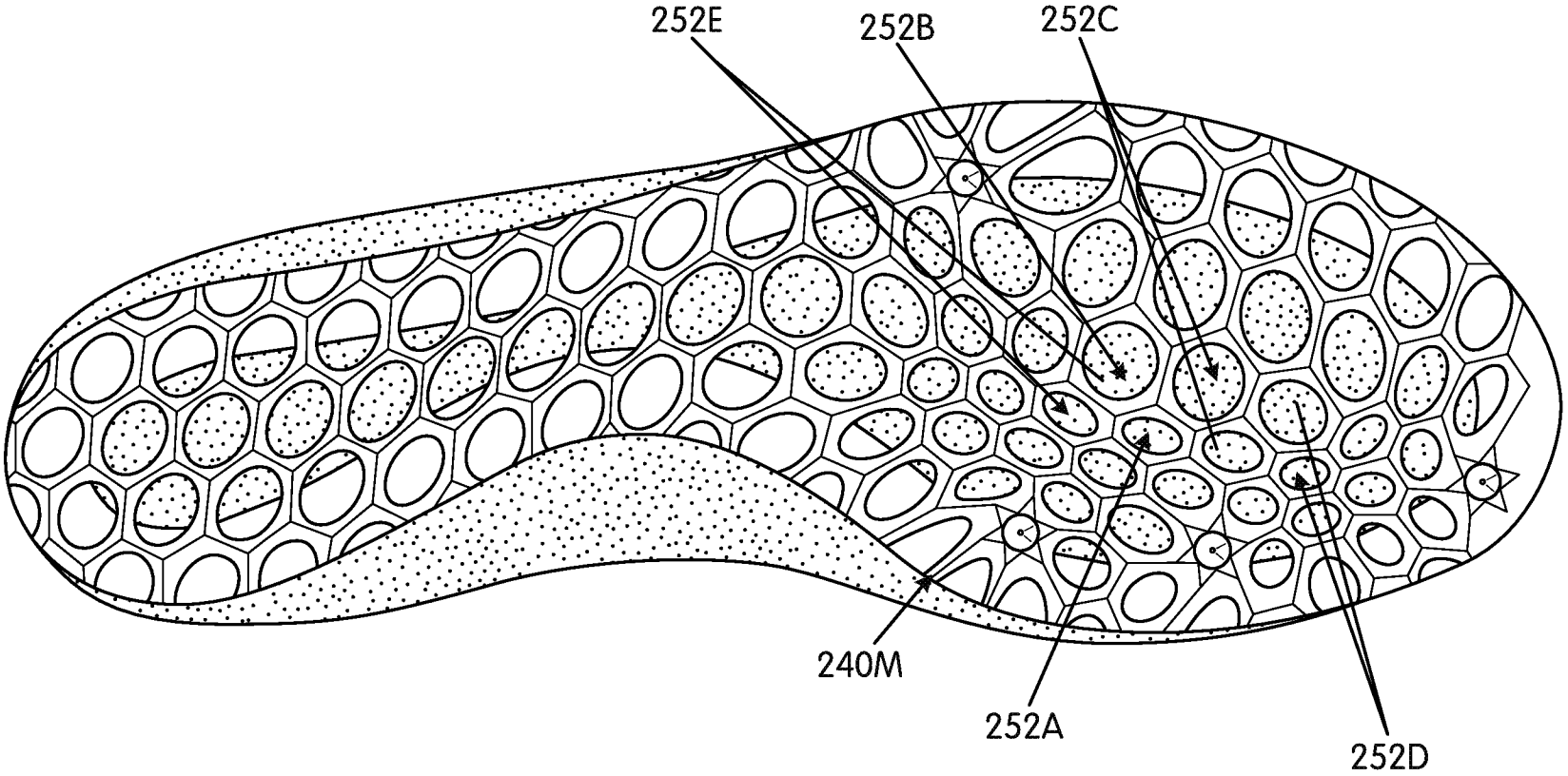
Figure 3D:
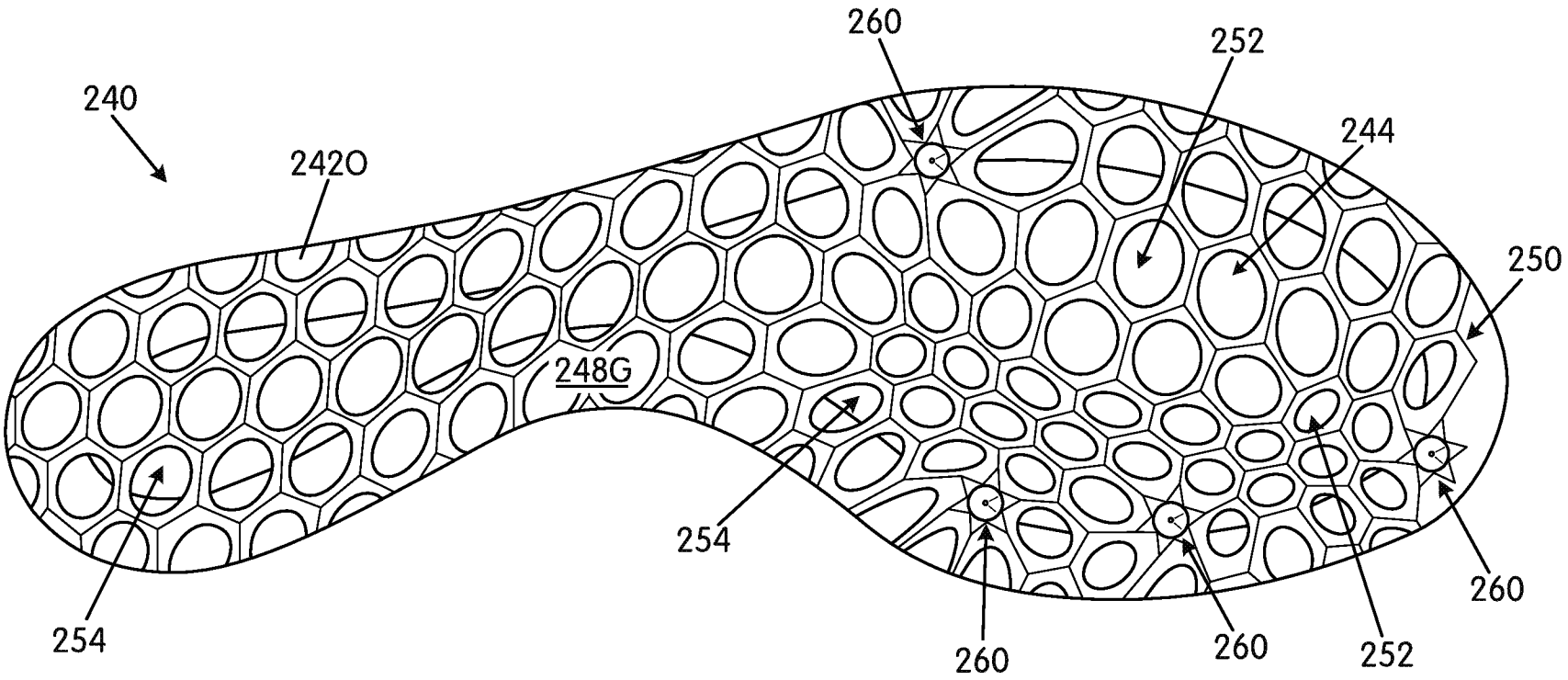
Figure 3E:
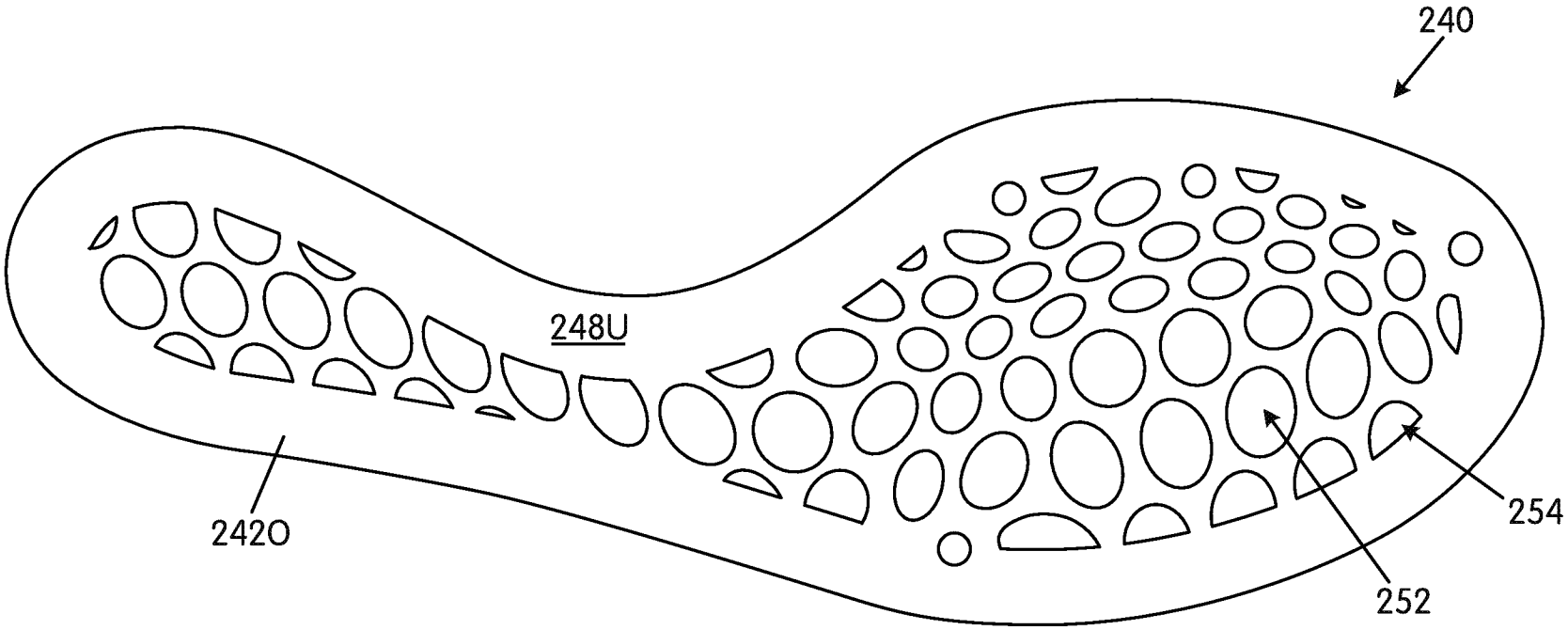
Figure 4:
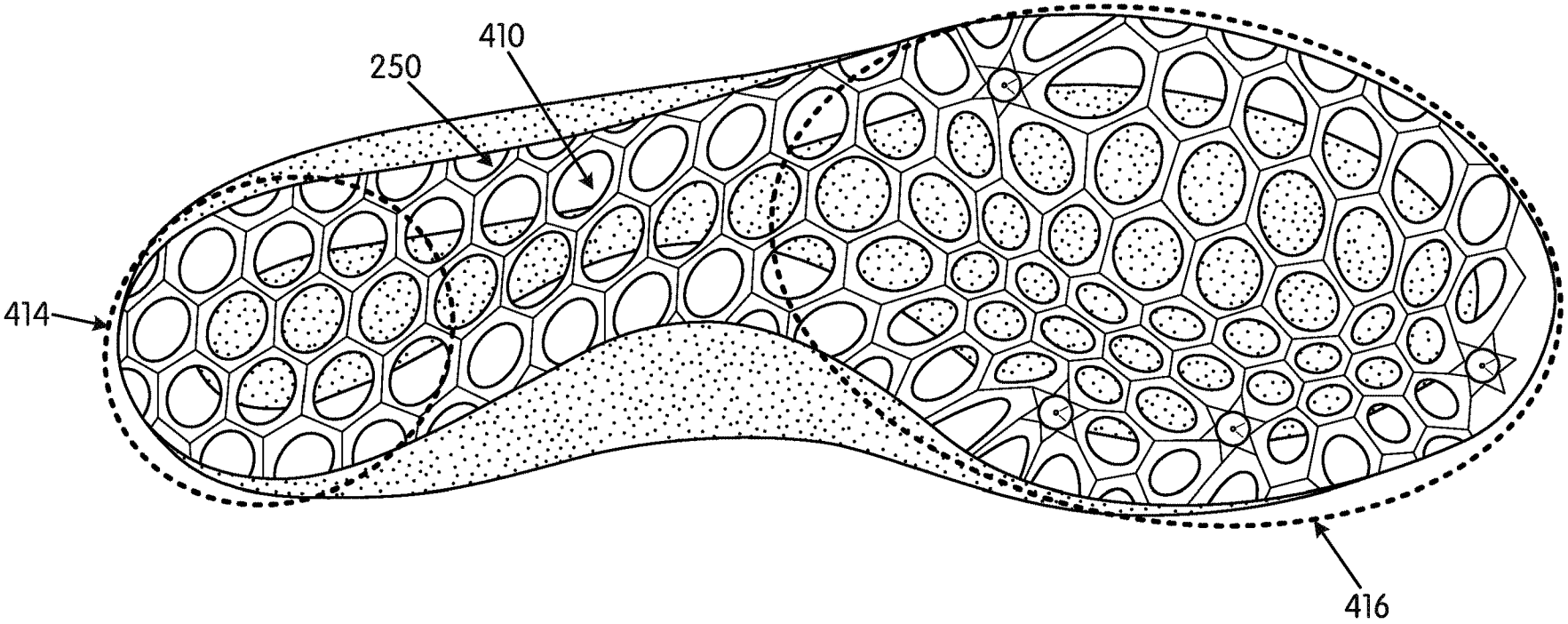

Additional potential features of various specific areas of the ground-engaging component 240 now will be described in more detail. As shown in FIG. 3C, in the forefoot support area, the matrix structure 250 of this example defines a first open cell (e.g., 252A) and an adjacent second open cell (252B) in which the first open cell 252A has a cross sectional area (area of the opening) of less than 50% (and in some adjacent cell pairs, less than 35% or even less than 25%) of a cross sectional area (area of the opening) of the second open cell 252B. Further, a geographic center of the first (smaller) open cell 252A is located closer to the medial side edge 240M than is a geographic center of the second (larger) open cell 252B. As shown in FIG. 3C, the first (smaller) open cell 252A is elongated in a front-to-rear direction. Also, while not shown in specifically identified cells in FIG. 3C, the second (larger) open cell 252B may be elongated in a medial side-to-lateral side direction, if desired. The matrix structure 250 of FIG. 3C includes additional adjacent cell pairs (e.g., 252C, 252D, and 252E) having one or more of the same relative size and/or location characteristics of adjacent cell pair 252A/252B described above. Also, if desired, the adjacent cell pairs (e.g., 252A/B, 252C, 252D, 252E) may lie adjacent one another (e.g., with the smaller cells of the pair (closer to the medial side edge 240M) adjacent one another moving in the front-to-back direction and the larger cells of the pair (further from the medial side edge 240M) adjacent one another moving in the front-to-back direction.

As further shown with respect to the open cells labeled 252A-252E in FIG. 3C, the larger and smaller open cells may be arranged adjacent one another in generally triangular arrangements and/or such that some open cells 252 (or other cells) will have six cells around and adjacent to them. More specifically, the cells 252A-252E (and others) are arranged such that two smaller, adjacent (and closer to the medial side edge 240M) open cells are located adjacent one larger open cell (which is located further from the medial side edge 240M than the two smaller adjacent open cells). Likewise, two larger, adjacent (and further from the medial side edge 240M) open cells are located adjacent one smaller open cell (which is located closer the medial side edge 240M than the two larger adjacent open cells). Thus, two of the smaller open cells and one larger open cell are located in a generally triangular arrangement and two larger open cells and one smaller open cell are located in a generally triangular arrangement. This generally triangular arrangement may be repeated one or more times in the forefoot matrix structure area.

Figure 5B:
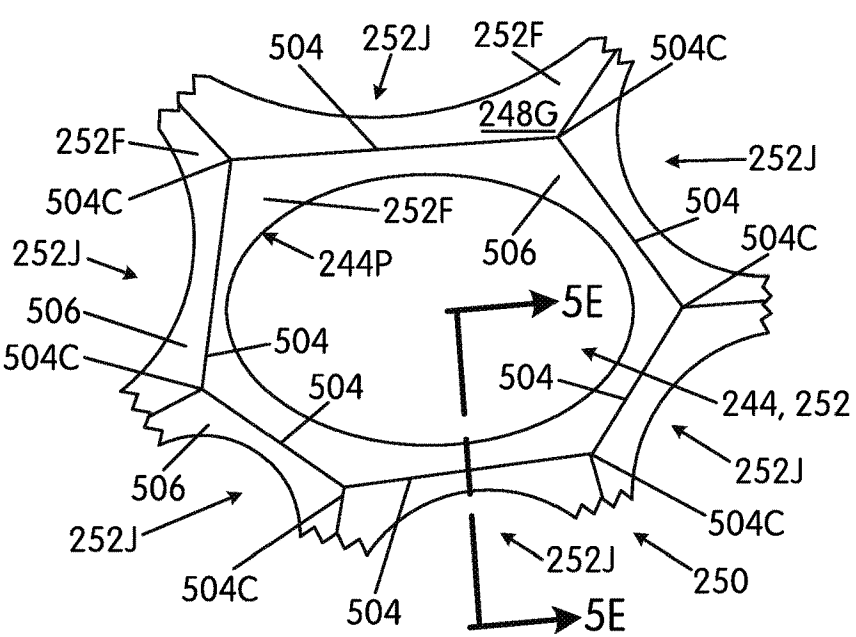
FIGS. 5A-5H provide various views to illustrate additional features of the ground-engaging component's support structure in accordance with some example features of this invention.
Figure 5A:
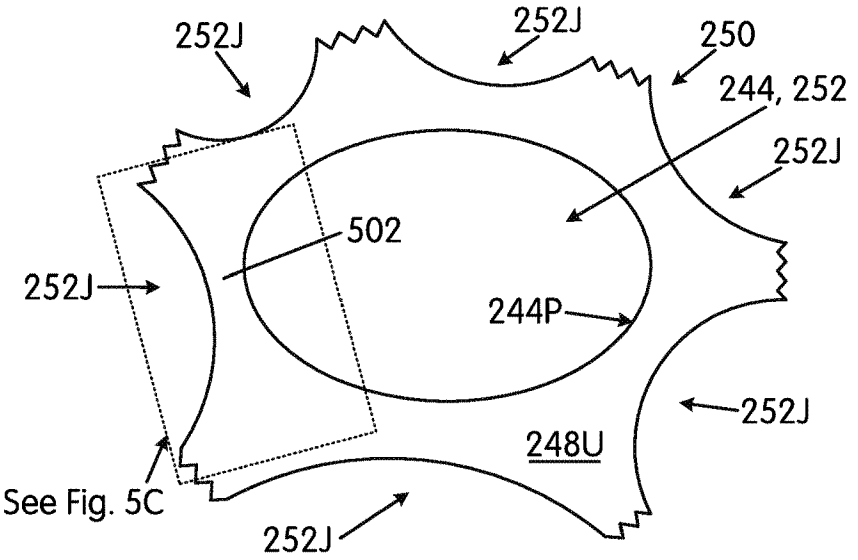
Figure 5E:
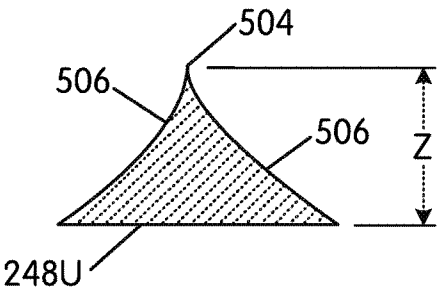
Figure 5D:
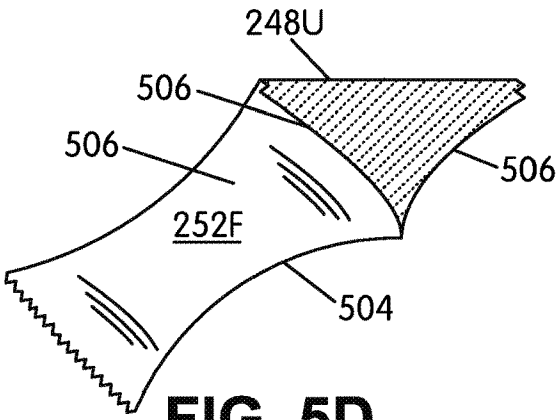
Figure 5C:
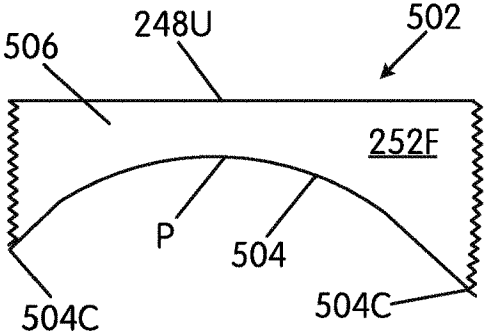

FIGS. 5A through 5H are provided to help illustrate potential features of the matrix structure 250 and the various cells described above. FIG. 5A provides an enlarged top view showing the upper-facing surface 248U at an area around an open cell 252 defined by the matrix structure 250 (the open space is shown at 244). FIG. 5B shows an enlarged bottom view of this same area of the matrix structure 250 (showing the ground-facing surface 248G). FIG. 5C shows a side view at one leg 502 of the matrix structure 250, and FIG. 5D shows a cross-sectional and partial perspective view of this same leg 502 area. As shown in these figures, the matrix structure 250 provides a smooth top (upper-facing) surface 248U but a more angular ground-facing surface 248G. More specifically, at the ground-facing surface 248G, the matrix structure 250 defines a generally hexagonal ridge 504 around the open cell 252, with the corners 504C of the hexagonal ridge 504 located at a junction area between three adjacent cells in a generally triangular arrangement (the junction of the open cell 252 and two adjacent cells 252J, which may be open, partially open, and/or closed cells, in this illustrated example).

As further shown in these figures, along with FIG. 5E (which shows a sectional view along line 5E-5E of FIG. 5B), the side walls 506 between the upper-facing surface 248U at cell perimeter 244P and the ground-facing surface 248G, which ends at ridge 504 in this example, are sloped. Thus, the overall matrix structure 250, at least at some locations between the generally hexagonal ridge 504 corners 504C, may have a triangular or generally triangular shaped cross section (e.g., see FIGS. 5D and 5E). Moreover, as shown in FIGS. 5C and 5D, the generally hexagonal ridge 504 may be sloped or curved from one corner 504C to the adjacent corners 504C (e.g., with a local maxima point P located between adjacent corners 504C). The side walls 506 may have a planar surface (e.g., like shown in FIG. 5H), a partially planar surface (e.g., planar along some of its height/thickness dimension Z), a curved surface (e.g., a concave surface as shown in FIG. 5E), or a partially curved surface (e.g., curved along some of its height dimension Z).

The raised corners 504C of the generally hexagonal ridge 504 in this illustrated example ground-engaging component 240 may be formed as sharp peaks that may act as secondary traction elements at desired locations around the ground-engaging component 240. As evident from these figures and the discussion above, the generally hexagonal ridges 504 and side walls 506 from three adjacent cells (e.g., 252 and two 252J cells) meet at a single (optionally raised) corner 504C and thus may form a substantially pyramid type structure (e.g., a pyramid having three side walls 252F, 506 that meet at a point 504C). This substantially pyramid type structure can have a sharp point (e.g., depending on the slopes of walls 252F, 506), which can function as a secondary traction element when it contacts the ground in use. This same type of pyramid structure formed by matrix 250 also may be used to form the secondary traction elements 264 at cleat support areas 260.

Not every cell (open, partially open, or closed) in the ground-engaging component 240 needs to have this type of secondary traction element structure (e.g., with raised pointed pyramids at the generally hexagonal ridge 504 corners 504C), and in fact, not every generally hexagonal ridge 504 corner 504C around a single cell 252 needs to have a raised secondary traction element structure. One or more of the ridge components 504 of a given cell 252 may have a generally straight line structure along the ground-facing surface 248G and/or optionally a linear or curved structure that moves closer to the upper-facing surface 248U moving from one corner 504C to an adjacent corner 504C. In this manner, secondary traction elements may be placed at desired locations around the ground-engaging element 240 structure and left out (e.g., with smooth corners 504C and/or edges in the z-direction) at other desired locations. Additionally or alternatively, if desired, raised points and/or other secondary traction elements could be provided at other locations on the matrix structure 250, e.g., anywhere along ridge 504 or between adjacent cells. As some more specific examples, a portion of the arch support area (e.g., area 410 in FIG. 4) may have no or fewer prominent secondary traction elements (e.g., smoother matrix 250 walls), while other areas (e.g., the heel support area 414, the forefoot area 416 (e.g., including one or more of the forward toe area, the lateral forefoot side support area, the medial forefoot side support area, and/or the central forefoot support area, including areas beneath at least some of the metatarsal head support areas) may include the secondary traction elements (or more pronounced secondary traction elements).

Notably, in this example construction, the matrix structure 250 defines at least some of the cells 252 (and 252J) such that the perimeter of the entrance to the cell opening 252 around the upper-facing surface 248U (e.g., defined by perimeter 244P of the ovoid shaped opening) is smaller than the perimeter of the entrance to the cell opening 252 around the ground-facing surface 248G (e.g., defined by the generally hexagonal perimeter ridge 504). Stated another way, the area of the entrance to the cell opening 252 from the upper-facing surface 248U (e.g., the area within and defined by the perimeter 244P of the ovoid shaped opening) is smaller than the area of the entrance to the cell opening 252 from the ground-facing surface 248G (e.g., the area within and defined by the generally hexagonal perimeter ridge 504). The generally hexagonal perimeter ridge 504 completely surrounds the perimeter 244P in at least some cells. These differences in the entrance areas and sizes are due to the sloped/curved sides walls 506 from the upper-facing surface 248U to the ground-facing surface 248G.

Figure 5G:
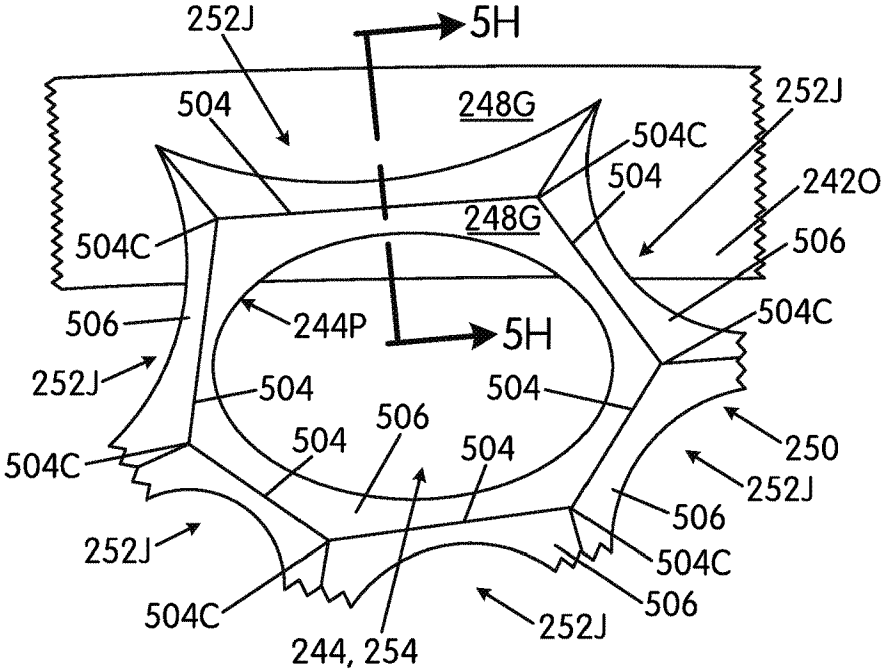
Figure 5F:
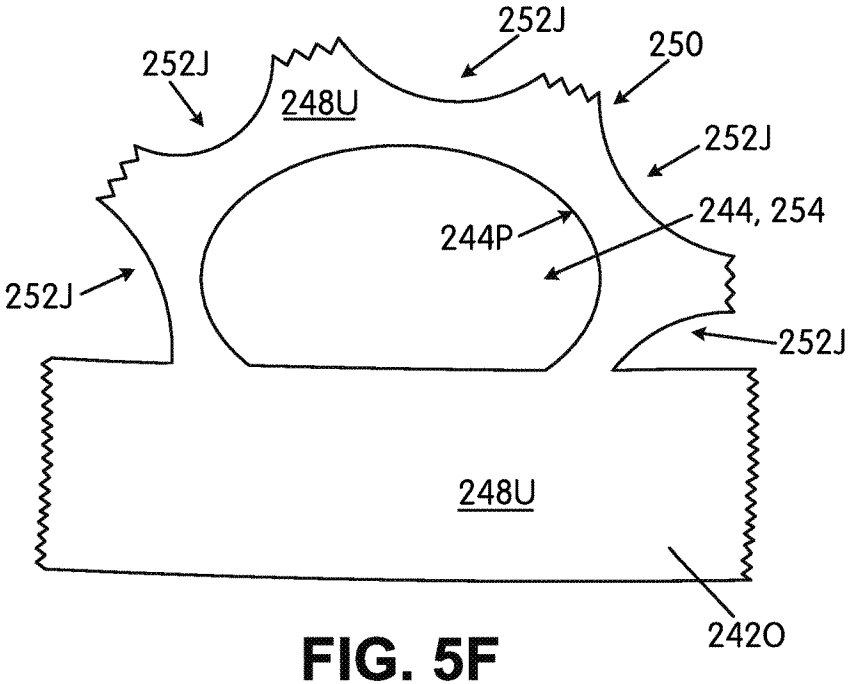
Figure 5H:
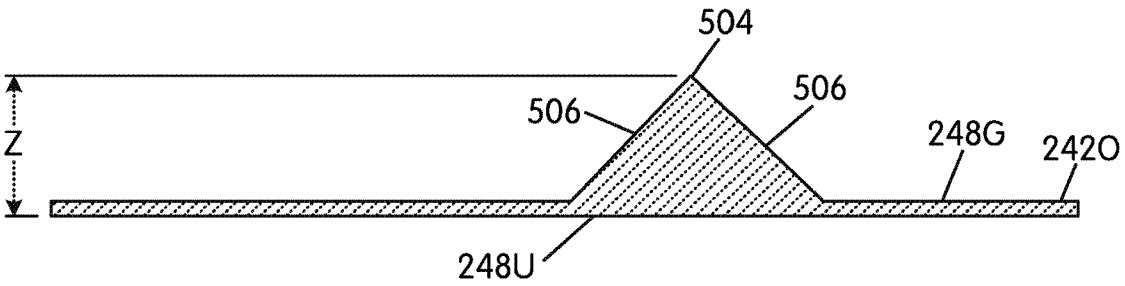

FIGS. 5F through 5H show views similar to those in FIGS. 5A, 5B, and 5E but with a portion of the matrix structure 250 originating in the outer perimeter boundary rim 242O (and thus the cell is a partially open cell 254). As shown in FIG. 5G, in this illustrated example, the matrix structure 250 morphs outward and downward from the ground-facing surface 248G of the outer perimeter boundary rim 242O. This may be accomplished, for example, by molding the matrix structure 250 as an unitary, one-piece component with the outer perimeter boundary rim member 242O. Alternatively, the matrix structure 250 could be formed as a separate component that is fixed to the outer perimeter boundary rim member 242O, e.g., by cements or adhesives, by mechanical connectors, etc. As another option, the matrix structure 250 may be made as an unitary, one-piece component with the outer perimeter boundary rim member 242O by rapid manufacturing techniques, including rapid manufacturing additive fabrication techniques (e.g., 3D printing, laser sintering, etc.) or rapid manufacturing subtractive fabrication techniques (e.g., laser ablation, etc.). The structures and various parts shown in FIGS. 5F-5H may have any one or more of the various characteristics, options, and/or features of the similar structures and parts shown in FIGS. 5A-5E (and like reference numbers in these figures represent the same or similar parts to those used in other figures).

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes the subject-matter described in the following numbered paragraphs (referred to as "para." or "paras."):

[Para. 1]. A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component; and a matrix structure extending from the outer perimeter boundary rim and at least partially across the open space at least at the forefoot support area to define an open cellular construction with plural open cells across the open space at least at the forefoot support area, wherein at least a majority of the open cells of the open cellular construction have curved perimeters with no distinct corners.

[Para. 2]. The ground-engaging component according to Para. 1, wherein the matrix structure further defines a first cleat support area at or at least partially within the ground-facing surface of the outer perimeter boundary rim.

[Para. 3]. The ground-engaging component according to Para. 2, wherein the first cleat support area is a primary cleat mount area located at or at least partially within the ground-facing surface of a lateral side of the outer perimeter boundary rim.

[Para. 4]. The ground-engaging component according to Para. 3, wherein the first cleat support area is the sole primary cleat mount area located at or at least partially within the ground-facing surface of the lateral side of the outer perimeter boundary rim.

[Para. 5]. The ground-engaging component according to any one of Paras. 2 through 4, further comprising:

a track spike engaged at the first cleat support area.

[Para. 6]. The ground-engaging component according to any one of Paras. 2 through 5, wherein the matrix structure further defines a plurality of secondary traction elements dispersed around the first cleat support area.

[Para. 7]. The ground-engaging component according to any preceding Para., wherein the matrix structure defines secondary traction elements dispersed around a plurality of individual open cells of the open cellular construction that have the curved perimeters with no distinct corners, wherein at least some of the plurality of individual open cells include at least four secondary traction elements dispersed around them.

[Para. 8]. The ground-engaging component according to one of Paras. 1 through 6, wherein the matrix structure defines secondary traction elements dispersed around a plurality of individual open cells of the open cellular construction that have the curved perimeters with no distinct corners, wherein at least some of the plurality of individual open cells include six secondary traction elements dispersed around them.

[Para. 9]. The ground-engaging component according to Para. 7 or Para. 8, wherein at least some of the plurality of individual open cells that include secondary traction elements dispersed around them are located at a medial forefoot support area of the ground-engaging component.

[Para. 10]. The ground-engaging component according to Para. 7 or Para. 8, wherein at least some of the plurality of individual open cells that include secondary traction elements dispersed around them are located at a first metatarsal head support area of the ground-engaging component.

[Para. 11]. The ground-engaging component according to Para. 1, wherein the matrix structure further defines:

a first cleat support area at or at least partially in a lateral side of the ground-facing surface of the outer perimeter boundary rim;

a second cleat support area at or at least partially in a medial side of the ground-facing surface of the outer perimeter boundary rim; and a third cleat support area at or at least partially in the medial side of the ground-facing surface of the outer perimeter boundary rim and located forward of the second cleat support area.

[Para. 12]. The ground-engaging component according to Para. 11, further comprising a first track spike engaged at the first cleat support area, a second track spike engaged at the second cleat support area, and a third track spike engaged at the third cleat support area.

[Para. 13]. The ground-engaging component according to Para. 11, wherein the matrix structure further defines:

a fourth cleat support area at or at least partially in the ground-facing surface of the outer perimeter boundary rim and located forward of the third cleat support area.

[Para. 14]. The ground-engaging component according to Para. 13, further comprising a first track spike engaged at the first cleat support area, a second track spike engaged at the second cleat support area, a third track spike engaged at the third cleat support area, and a fourth track spike engaged at the fourth cleat support area.

[Para. 15]. The ground-engaging component according to any one of Paras. 1 through 14, wherein an average open cell size defined by the matrix structure on a medial forefoot side support area of the ground-engaging component is smaller than an average open cell size defined by the matrix structure on a lateral forefoot side support area of the ground-engaging component.

[Para. 16]. The ground-engaging component according to any one of Paras. 1 through 14, wherein an average open cell size defined by the matrix structure at a first metatarsal head support area of the ground-engaging component is smaller than an average open cell size defined by the matrix structure at a fourth and fifth metatarsal head support area of the ground-engaging component.

[Para. 17]. The ground-engaging component according to any one of Paras. 1 through 14, wherein an average open cell size defined by the matrix structure on a medial side of a longitudinal center line of the ground-engaging component is smaller than an average open cell size defined by the matrix structure on a lateral side of the longitudinal center line.

[Para. 18]. The ground-engaging component according to any preceding Para., wherein in the forefoot support area, the matrix structure defines a first open cell, an adjacent second open cell, and an adjacent third open cell, wherein an opening of the first open cell has a cross sectional area of less than 50% of a cross sectional area of an opening of the second open cell and of less than 50% of a cross sectional area of an opening of the third open cell, and wherein a geographic center of the first open cell is located closer to a medial side edge of the outer perimeter boundary rim than is a geographic center of the second open cell and closer to the medial side edge than is a geographic center of the third open cell.

[Para. 19]. The ground-engaging component according to Para. 18, wherein the first open cell is elongated in a front-to-rear direction.

[Para. 20]. The ground-engaging component according to Para. 18 or Para. 19, wherein in the forefoot support area, the matrix structure further defines a fourth open cell that is adjacent to the third open cell and a fifth open cell, wherein the fourth open cell has an opening with a cross sectional area of less than 50% of the cross sectional area of the opening of the third open cell and of less than 50% of a cross sectional area of an opening of the fifth open cell, and wherein a geographic center of the fourth open cell is located closer to the medial side edge than is the geographic center of the third open cell and closer to the medial side edge than is a geographic center of the fifth open cell.

[Para. 21]. The ground-engaging component according to Para. 18 or Para. 19, wherein in the forefoot support area, the matrix structure further defines a fourth open cell that is adjacent to a fifth open cell and a sixth open cell, wherein the fourth open cell has an opening with a cross sectional area of less than 50% of the cross sectional area of an opening of the fifth open cell and of less than 50% of a cross sectional area of an opening of the sixth open cell, and wherein a geographic center of the fourth open cell is located closer to the medial side edge than is the geographic center of the fifth open cell and closer to the medial side edge than is a geographic center of the sixth open cell.

[Para. 22]. The ground-engaging component according to Para. 21, wherein the first open cell is separated from the fourth open cell by a seventh open cell.

[Para. 23]. The ground-engaging component according to Para. 22, wherein the seventh open cell is adjacent to the third open cell and the fifth open cell.

[Para. 24]. The ground-engaging component according to Para. 23, wherein the seventh open cell has an opening with a cross sectional area of less than 50% of the cross sectional area of the opening of the third open cell and of less than 50% of a cross sectional area of the opening of the fifth open cell, and wherein a geographic center of the seventh open cell is located closer to the medial side edge than is the geographic center of the third open cell and closer to the medial side edge than is the geographic center of the fifth open cell.

[Para. 25]. The ground-engaging component according to any preceding Para., wherein the matrix structure defines a first set of open cells including at least four open cells that are substantially aligned in the forefoot support area along a line extending in a forward medial-to-rear lateral direction.

[Para. 26]. The ground-engaging component according to Para. 25, wherein the first set of open cells includes at least six cells that are substantially aligned along the line.

[Para. 27]. The ground-engaging component according to any preceding Para., wherein the outer perimeter boundary rim is at least 4 mm wide.

[Para. 28]. The ground-engaging component according to any preceding Para., wherein the outer perimeter boundary rim is present around at least 80% of the outer perimeter of the ground-engaging component.

[Para. 29]. The ground-engaging component according to any preceding Para., wherein at least 80% of the open cells of the open cellular construction have curved perimeters with no distinct corners.

[Para. 30]. An article of footwear, comprising:

an upper; and a sole structure including a ground-engaging component according to any preceding Para, engaged with the upper.

[Para. 31]. The article of footwear according to Para. 30, wherein at least a portion of the upper includes a woven textile component.

[Para. 32]. The article of footwear according to Para. 30, wherein at least a portion of the upper includes a knitted textile component.

[Para. 33]. The article of footwear according to any one of Paras. 30 through 32, wherein the sole structure consists essentially of the ground-engaging component.

[Para. 34]. The article of footwear according to any one of Paras. 30 through 33, wherein the upper-facing surface of the ground-engaging support component is directly engaged with the upper.

What is claimed is:

1. A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component;

a matrix structure extending from the outer perimeter boundary rim and at least partially across the open space at least at the forefoot support area to define an open cellular construction with plural open cells across the open space at least at the forefoot support area, wherein the matrix structure further defines a first cleat support area at or at least partially within the ground-facing surface of the outer perimeter boundary rim, wherein the matrix structure further defines a plurality of secondary traction elements, and wherein the plurality of secondary traction elements includes six pyramid structures, each having a single peak, formed in the matrix structure and dispersed around the first cleat support area; and a primary cleat connected to the first cleat support area, wherein the primary cleat constitutes a track spike having a single point, and wherein the single peaks of the six pyramid structures included as the plurality of secondary traction elements dispersed around the first cleat support area are located within 1.5 inches of the single point of the track spike.

2. The ground-engaging component according to claim 1, wherein the single peaks of the six pyramid structures included as the plurality of secondary traction elements dispersed around the first cleat support area are located within 1 inch of the single point of the track spike.

3. The ground-engaging component according to claim 2, wherein the first cleat support area is located at or at least partially within the ground-facing surface of a lateral side of the outer perimeter boundary rim.

4. The ground-engaging component according to claim 1, wherein the track spike constitutes a single and only primary cleat located at or at least partially within the ground-facing surface at a lateral side of the outer perimeter boundary rim.

5. The ground-engaging component according to claim 1, wherein the matrix structure further defines additional secondary traction elements dispersed around a plurality of individual open cells of the open cellular construction, wherein at least some of the plurality of individual open cells include six additional secondary traction elements dispersed around them.

6. The ground-engaging component according to claim 5, wherein at least some of the plurality of individual open cells that include additional secondary traction elements dispersed around them are located at a medial forefoot support area of the ground-engaging component or at a first metatarsal head support area of the ground-engaging component.

7. The ground-engaging component according to claim 1, wherein the first cleat support area is located at or at least partially in a lateral side of the ground-facing surface of the outer perimeter boundary rim, and wherein the matrix structure further defines:

a second cleat support area at or at least partially in a medial side of the ground-facing surface of the outer perimeter boundary rim; and a third cleat support area at or at least partially in the medial side of the ground-facing surface of the outer perimeter boundary rim and located forward of the second cleat support area.

8. The ground-engaging component according to claim 7, wherein the matrix structure further defines:

a fourth cleat support area at or at least partially in the ground-facing surface of the outer perimeter boundary rim and located forward of the third cleat support area.

9. The ground-engaging component according to claim 1, wherein an average open cell size defined by the matrix structure at a first metatarsal head support area of the ground-engaging component is smaller than an average open cell size defined by the matrix structure at a fourth and fifth metatarsal head support area of the ground-engaging component.

10. The ground-engaging component according to claim 1, wherein an average open cell size defined by the matrix structure on a medial side of a longitudinal center line of the ground-engaging component is smaller than an average open cell size defined by the matrix structure on a lateral side of the longitudinal center line.

11. The ground-engaging component according to claim 1, wherein in the forefoot support area, the matrix structure defines a first open cell, an adjacent second open cell, and an adjacent third open cell, wherein an opening of the first open cell has a cross sectional area of less than 50% of a cross sectional area of an opening of the second open cell and of less than 50% of a cross sectional area of an opening of the third open cell, and wherein a geographic center of the first open cell is located closer to a medial side edge of the outer perimeter boundary rim than is a geographic center of the second open cell and closer to the medial side edge than is a geographic center of the third open cell.

12. The ground-engaging component according to claim 11, wherein in the forefoot support area, the matrix structure further defines a fourth open cell that is adjacent to the third open cell and a fifth open cell, wherein the fourth open cell has an opening with a cross sectional area of less than 50% of the cross sectional area of the opening of the third open cell and of less than 50% of a cross sectional area of an opening of the fifth open cell, and wherein a geographic center of the fourth open cell is located closer to the medial side edge than is the geographic center of the third open cell and closer to the medial side edge than is a geographic center of the fifth open cell.

13. The ground-engaging component according to claim 11, wherein in the forefoot support area, the matrix structure further defines a fourth open cell that is adjacent to a fifth open cell and a sixth open cell, wherein the fourth open cell has an opening with a cross sectional area of less than 50% of the cross sectional area of an opening of the fifth open cell and of less than 50% of a cross sectional area of an opening of the sixth open cell, and wherein a geographic center of the fourth open cell is located closer to the medial side edge than is the geographic center of the fifth open cell and closer to the medial side edge than is a geographic center of the sixth open cell.

14. The ground-engaging component according to claim 13, wherein the first open cell is separated from the fourth open cell by a seventh open cell and wherein the seventh open cell is adjacent to the third open cell and the fifth open cell.

15. The ground-engaging component according to claim 14, wherein the seventh open cell has an opening with a cross sectional area of less than 50% of the cross sectional area of the opening of the third open cell and of less than 50% of a cross sectional area of the opening of the fifth open cell, and wherein a geographic center of the seventh open cell is located closer to the medial side edge than is the geographic center of the third open cell and closer to the medial side edge than is the geographic center of the fifth open cell.

16. The ground-engaging component according to claim 1, wherein the matrix structure defines a first set of open cells including at least four open cells that are substantially aligned in the forefoot support area along a line extending in a forward medial-to-rear lateral direction.

17. An article of footwear, comprising:

an upper; and a sole structure engaged with the upper, the sole structure including a ground-engaging component having:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component;

a matrix structure extending from the outer perimeter boundary rim and at least partially across the open space at least at the forefoot support area to define an open cellular construction with plural open cells across the open space at least at the forefoot support area, wherein the matrix structure further defines a first cleat support area at or at least partially within the ground-facing surface of the outer perimeter boundary rim, wherein the matrix structure further defines a plurality of secondary traction elements, and wherein the plurality of secondary traction elements includes six pyramid structures, each having a single peak, formed in the matrix structure and dispersed around the first cleat support area; and a primary cleat connected to the first cleat support area, wherein the primary cleat constitutes a track spike having a single point, and wherein the single peaks of the six pyramid structures included as the plurality of secondary traction elements dispersed around the first cleat support area are located within 1.5 inches of the single point of the track spike.

18. The article of footwear according to claim 17, wherein at least a portion of the upper includes a knitted textile component or a woven textile component.

19. The article of footwear according to claim 17, wherein the upper-facing surface of the ground-engaging support component is directly engaged with the upper.

20. A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component;

a matrix structure extending from the outer perimeter boundary rim and at least partially across the open space at least at the forefoot support area to define an open cellular construction with plural open cells across the open space at least at the forefoot support area, wherein the matrix structure further defines:

(a) a first cleat support area at or at least partially within the ground-facing surface of a lateral side of the outer perimeter boundary rim and a first plurality of secondary traction elements dispersed, wherein the first plurality of secondary traction elements includes six pyramid structures, each having a single peak, formed in the matrix structure and dispersed around the first cleat support area, (b) a second cleat support area at or at least partially within the ground-facing surface of a medial side of the outer perimeter boundary rim and a second plurality of secondary traction elements, wherein the second plurality of secondary traction elements includes six pyramid structures, each having a single peak, formed in the matrix structure and dispersed around the second cleat support area, (c) a third cleat support area at or at least partially within the ground-facing surface of the medial side of the outer perimeter boundary rim and a third plurality of secondary traction elements, wherein the third plurality of secondary traction elements includes six pyramid structures, each having a single peak, formed in the matrix structure and dispersed around the third cleat support area, and wherein the third cleat support area is located forward of the second cleat support area, and (d) a fourth cleat support area at or at least partially within the ground-facing surface of the medial side of the outer perimeter boundary rim and a fourth plurality of secondary traction elements, wherein the fourth plurality of secondary traction elements includes six pyramid structures, each having a single peak, formed in the matrix structure and dispersed around the fourth cleat support area, and wherein the fourth cleat support area is located forward of the third cleat support area;

a first track spike connected to the first cleat support area, wherein the first track spike has a single point, and wherein the single peaks of the six pyramid structures included as the first plurality of secondary traction elements dispersed around the first cleat support area are located within 1 inch of the single point of the first track spike;

a second track spike connected to the second cleat support area, wherein the second track spike has a single point, and wherein the single peaks of the six pyramid structures included as the second plurality of secondary traction elements dispersed around the second cleat support area are located within 1 inch of the single point of the second track spike;

a third track spike connected to the third cleat support area, wherein the third track spike has a single point, and wherein the single peaks of the six pyramid structures included as the third plurality of secondary traction elements dispersed around the third cleat support area are located within 1 inch of the single point of the third track spike; and a fourth track spike connected to the fourth cleat support area, wherein the fourth track spike has a single point, and wherein the single peaks of the six pyramid structures included as the fourth plurality of secondary traction elements dispersed around the fourth cleat support area are located within 1 inch of the single point of the fourth track spike.

* * * * *